US010482818B2

(12) United States Patent
Kwon et al.

(10) Patent No.: US 10,482,818 B2
(45) Date of Patent: Nov. 19, 2019

(54) PIXEL CONTROLLED VIA EMISSION CONTROL SIGNALS DURING SUB-PERIODS AND DISPLAY DEVICE INCLUDING THE SAME

(71) Applicant: Samsung Display Co., Ltd., Yongin-si, Gyeonggi-do (KR)

(72) Inventors: Tae Hoon Kwon, Yongin-si (KR); Ji Hyun Ka, Yongin-si (KR); Min Ku Lee, Yongin-si (KR); Seung Ji Cha, Yongin-si (KR); Hyun Uk Oh, Yongin-si (KR); Jin Tae Jeong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/882,734

(22) Filed: Jan. 29, 2018

(65) Prior Publication Data

US 2018/0218678 A1 Aug. 2, 2018

(30) Foreign Application Priority Data

Feb. 1, 2017 (KR) ..... 10-2017-0014243

(51) Int. Cl.
*G09G 5/10* (2006.01)
*G09G 3/3233* (2016.01)
(Continued)

(52) U.S. Cl.
CPC ..... *G09G 3/3233* (2013.01); *G09G 3/2018* (2013.01); *G09G 3/3266* (2013.01); *G09G 3/3275* (2013.01); *G09G 2300/0426* (2013.01); *G09G 2300/0819* (2013.01); *G09G 2300/0842* (2013.01); *G09G 2300/0861* (2013.01); *G09G 2310/0256* (2013.01);
(Continued)

(58) Field of Classification Search
None
See application file for complete search history.

(56) References Cited

U.S. PATENT DOCUMENTS 9,269,294 B2 2/2016 Eom et al.
2005/0024309 A1* 2/2005 Yamazaki ..... G09G 3/2025 345/87
(Continued)

FOREIGN PATENT DOCUMENTS

KR 10-0200369 B1 6/1999
KR 10-2013-0136338 A 12/2013

*Primary Examiner* — Lunyi Lao
*Assistant Examiner* — Kirk W Hermann
(74) *Attorney, Agent, or Firm* — Lewis Roca Rothgerber Christie LLP

(57) ABSTRACT

A display device includes pixels coupled to scan lines, emission control lines, and data lines, a scan driver configured to supply scan signals to the pixels through the scan lines, an emission driver configured to supply emission control signals to the pixels through the emission control lines, and a data driver configured to supply data signals to the pixels through the data lines, wherein the emission driver is configured to supply the emission control signals for each one of sub-periods in one frame period, and wherein a width of the emission control signals in any one sub-period from among the sub-periods is different from that of the emission control signals in another sub-period from among the sub-periods.

18 Claims, 13 Drawing Sheets

(51) Int. Cl.
*G09G 3/3266* (2016.01)
*G09G 3/3275* (2016.01)
*G09G 3/20* (2006.01)

(52) U.S. Cl.
CPC . *G09G 2310/0286* (2013.01); *G09G 2310/08* (2013.01); *G09G 2320/0238* (2013.01); *G09G 2320/0247* (2013.01); *G09G 2320/064* (2013.01); *G09G 2330/021* (2013.01)

(56) References Cited

U.S. PATENT DOCUMENTS

2006/0077138 A1* 4/2006 Kim ..... G09G 3/3233 345/76
2007/0126664 A1* 6/2007 Kimura ..... H01L 29/78678 345/76
2007/0279343 A1* 12/2007 Kim ..... G09G 3/2007 345/77
2015/0255523 A1* 9/2015 Her ..... H01L 27/3262 345/76

* cited by examiner

PIXEL CONTROLLED VIA EMISSION CONTROL SIGNALS DURING SUB-PERIODS AND DISPLAY DEVICE INCLUDING THE SAME

CROSS-REFERENCE TO RELATED APPLICATION

This application claims priority to and the benefit of Korean Patent Application No. 10-2017-0014243, filed on Feb. 1, 2017, in the Korean Intellectual Property Office, the entire disclosure of which is incorporated by reference herein.

BACKGROUND

1. Field

An aspect of the present disclosure relates to a pixel and a display device including the same.

2. Description of the Related Art

With the development of information technologies, the importance of display devices, which act as the connection media between users and information, has increased over time. Accordingly, display devices such as liquid crystal display devices and organic light emitting display devices are increasingly used.

Among these display devices, the organic light emitting display device displays images using organic light emitting diodes that generate light by recombination of electrons and holes. The organic light emitting display device has a high response speed and can display a clear image.

The organic light emitting display device includes pixels, a data driver for supplying data signals to the pixels, a scan driver for supplying scan signals to the pixels, and an emission driver for supplying emission control signals to the pixels.

SUMMARY

Aspects of embodiments are directed to a pixel and a display device including the same, which are capable of providing improved image quality by reducing a flicker phenomenon.

According to some embodiments of the present disclosure, there is provided a display device including: pixels coupled to scan lines, emission control lines, and data lines; a scan driver configured to supply scan signals to the pixels through the scan lines; an emission driver configured to supply emission control signals to the pixels through the emission control lines; and a data driver configured to supply data signals to the pixels through the data lines, wherein the emission driver is configured to supply the emission control signals for each one of sub-periods in one frame period, and wherein a width of the emission control signals in any one sub-period from among the sub-periods is different from that of the emission control signals in another sub-period from among the sub-periods.

In some embodiments, the emission driver is further configured to control a non-emission period of the pixels via the emission control signals.

In some embodiments, the one frame period includes a first sub-period, a second sub-period, a third sub-period, and a fourth sub-period, which are sequentially ordered, and a width of the emission control signals in the third sub-period is set wider than those of the emission control signals in other ones of the sub-periods.

In some embodiments, a pixel coupled to an ith (i being a natural number) emission control line and an mth (m being a natural number) data line from among the pixels includes: an organic light emitting diode; a first transistor configured to control an amount of driving current flowing from a first pixel power source to a second pixel power source via the organic light emitting diode, corresponding to a data signal of the data signals supplied to the mth data line; and an emission control transistor on a path of the driving current, the emission control transistor being configured to block the driving current, corresponding to an emission control signal of the emission control signals supplied from the ith emission control line.

In some embodiments, the pixel coupled to the ith emission control line and the mth data line further includes: a second transistor coupled between a first electrode of the first transistor and the mth data line; a third transistor coupled between a gate electrode of the first transistor and a second electrode of the first transistor; a fourth transistor coupled between the gate electrode of the first transistor and a third pixel power source; a fifth transistor coupled between the third pixel power source and an anode electrode of the organic light emitting diode; and a storage capacitor coupled between the first pixel power source and the gate electrode of the first transistor.

In some embodiments, the emission control transistor includes: a first emission control transistor coupled between the second electrode of the first transistor and the anode electrode of the organic light emitting diode, the first emission control transistor including a gate electrode coupled to the ith emission control line; and a second emission control transistor coupled between the first pixel power source and the first electrode of the first transistor, the second emission control transistor including a gate electrode coupled to the ith emission control line.

According to some embodiments of the present disclosure, there is provided a pixel including: an organic light emitting diode; a first transistor configured to control an amount of driving current flowing from a first pixel power source to a second pixel power source via the organic light emitting diode, corresponding to a data signal supplied to a data line; and an emission control transistor on a path of the driving current, the emission control transistor being configured to block the driving current, corresponding to an emission control signal supplied to an emission control line, wherein the emission control transistor is turned off for each one of sub-periods in one frame period, wherein an off period of the emission control transistor in any one sub-period among the sub-periods is different from that of the emission control transistor in another sub-period.

In some embodiments, the one frame period includes a first sub-period, a second sub-period, a third sub-period, and a fourth sub-period, which are sequentially ordered, and an off period of the emission control transistor in the third sub-period is set longer than those of the emission control transistor in other ones of the sub-periods.

In some embodiments, the pixel further includes: a second transistor coupled between a first electrode of the first transistor and the data line; a third transistor coupled between a gate electrode of the first transistor and a second electrode of the first transistor; a fourth transistor coupled between the gate electrode of the first transistor and a third pixel power source; a fifth transistor coupled between the third pixel power source and an anode electrode of the organic light emitting diode; and a storage capacitor coupled between the first pixel power source and the gate electrode of the first transistor.

In some embodiments, the emission control transistor includes: a first emission control transistor coupled between the second electrode of the first transistor and the anode electrode of the organic light emitting diode, the first emission control transistor including a gate electrode coupled to the emission control line; and a second emission control transistor coupled between the first pixel power source and the first electrode of the first transistor, the second emission control transistor including a gate electrode coupled to the emission control line.

According to some embodiments of the present disclosure, there is provided a display device including: pixels coupled to scan lines, emission control lines, initialization lines, and data lines, each one of the pixels including an organic light emitting diode; a scan driver configured to supply scan signals to the pixels through the scan lines; an emission driver configured to supply emission control signals to the pixels through the emission control lines; an initialization driver configured to supply initialization signals to the pixels through the initialization lines; and a data driver configured to supply data signals to the pixels through the data lines, wherein the organic light emitting diode of each one of the pixels is initialized in each one of sub-periods in one frame period.

In some embodiments, the initialization driver is configured to output the initialization signals during each one of the sub-periods, and the emission driver is configured to output the emission control signals during each one of the sub-periods.

In some embodiments, the initialization driver is configured to control initialization of the organic light emitting diodes via the initialization signals, and the emission driver is configured to control a non-emission period of the pixels via the emission control signals.

In some embodiments, a pixel coupled to an ith (i being a natural number) initialization line, an ith emission control line, and an mth (m being a natural number) data line from among the pixels includes: a first transistor configured to control an amount of driving current flowing from a first pixel power source to a second pixel power source via the organic light emitting diode, corresponding to a data signal of the data signals supplied to the mth data line; an initialization transistor configured to supply an initialization voltage to an anode electrode of the organic light emitting diode, corresponding to an initialization signal supplied to the ith initialization line; and an emission control transistor on a path of the driving current, the emission control transistor being configured to block the driving current, corresponding to an emission control signal of the emission control signals supplied to the ith emission control line.

In some embodiments, the pixel coupled to the ith initialization line, the ith emission control line, and the mth data line further includes: a second transistor coupled between a first electrode of the first transistor and the mth data line; a third transistor coupled between a gate electrode of the first transistor and a second electrode of the first transistor; a fourth transistor coupled between the gate electrode of the first transistor and a third pixel power source; and a storage capacitor coupled between the first pixel power source and the gate electrode of the first transistor.

In some embodiments, the emission control transistor includes: a first emission control transistor coupled between the second electrode of the first transistor and the anode electrode of the organic light emitting diode, the first emission control transistor including a gate electrode coupled to the ith emission control line; and a second emission control transistor coupled between the first pixel power source and the first electrode of the first transistor, the second emission control transistor including a gate electrode coupled to the ith emission control line.

According to some embodiments of the present disclosure, there is provided a pixel including: an organic light emitting diode; a first transistor configured to control an amount of driving current flowing from a first pixel power source to a second pixel power source via the organic light emitting diode, corresponding to a data signal supplied to a data line; an initialization transistor configured to supply an initialization voltage to an anode electrode of the organic light emitting diode, corresponding to an initialization signal supplied to an initialization line; and an emission control transistor located on a path of the driving current, the emission control transistor being configured to the driving current, corresponding to an emission control signal supplied to an emission control line, wherein the initialization transistor supplies the initialization voltage to the anode electrode of the organic light emitting diode for each one of sub-periods in one frame period.

In some embodiments, an on period of the initialization transistor overlaps with an off period of the emission control transistor during each one of the sub-periods.

In some embodiments, the pixel further includes: a second transistor coupled between a first electrode of the first transistor and the data line; a third transistor coupled between a gate electrode of the first transistor and a second electrode of the first transistor; a fourth transistor coupled between the gate electrode of the first transistor and a third pixel power source; and a storage capacitor coupled between the first pixel power source and the gate electrode of the first transistor.

In some embodiments, the emission control transistor includes: a first emission control transistor coupled between a second electrode of the first transistor and the anode electrode of the organic light emitting diode, the first emission control transistor including a gate electrode coupled to the emission control line; and a second emission control transistor coupled between the first pixel power source and the first electrode of the first transistor, the second emission control transistor including a gate electrode coupled to the emission control line.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. Like reference numerals refer to like elements throughout.

DETAILED DESCRIPTION

In the following detailed description, only certain exemplary embodiments of the present disclosure have been shown and described, simply by way of illustration. As those skilled in the art would realize, the described embodiments may be modified in different ways, all without departing from the spirit or scope of the present disclosure. Accordingly, the drawings and description are to be regarded as illustrative in nature and not restrictive.

In this specification, some of the elements that are not essential to the complete understanding of the disclosure may be omitted for clarity.

Hereinafter, a pixel and a display device including the same will be described with reference to exemplary embodiments in conjunction with the accompanying drawings.

Figure 1:
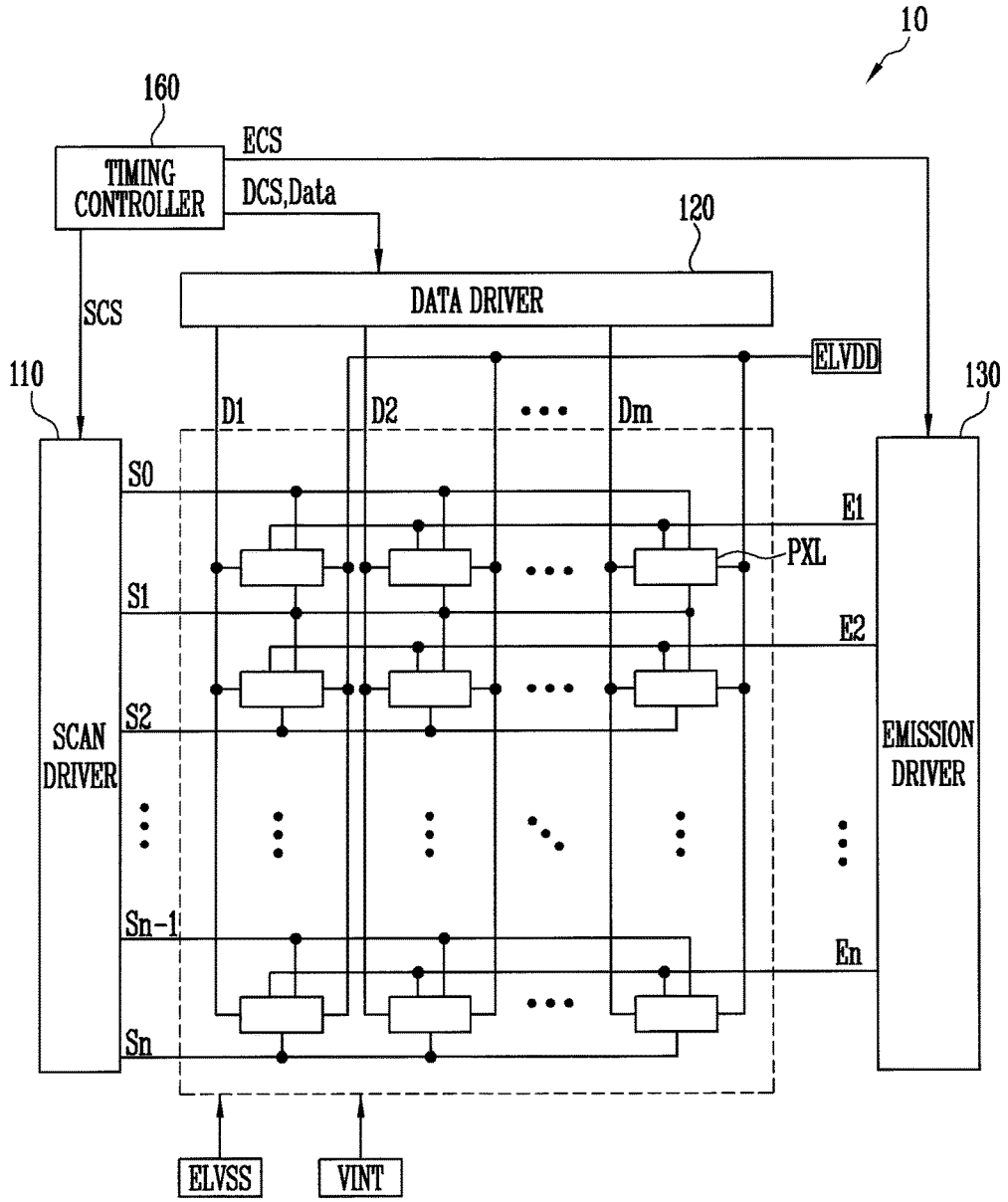
FIG. 1 is a block diagram illustrating a display device according to an embodiment of the present disclosure.

FIG. 1 is a block diagram illustrating a display device according to an embodiment of the present disclosure.

Referring to FIG. 1, the display device 10 according to the present disclosure may include pixels PXL, a scan driver 110, a data driver 120, an emission driver 130, and a timing controller 160.

The pixels PXL may be coupled to scan lines S0 to Sn, emission control lines E1 to En, and data lines D1 to Dm.

Also, the pixels PXL may be coupled to a first pixel power source ELVDD, a second pixel power source ELVSS, and a third pixel power source VINT.

The pixels PXL may be supplied with scan signals from the scan lines S0 to Sn, and be supplied with data signals synchronized with the scan signals from the data lines D1 to Dm.

Each of the pixels PXL supplied with the data signals may control the amount of driving current flowing from the first pixel power source ELVDD to the second pixel power source ELVSS via an organic light emitting diode. In this case, the organic light emitting diode may generate light with a luminance corresponding to the amount of the driving current.

In addition, each of the pixels PXL may be coupled to a plurality of scan lines. For example, each of the pixels PXL may be coupled to a current scan line and a previous scan line.

For example, pixels located on an ith horizontal line may be coupled to an ith scan line Si and an (i−1)th scan line Si−1.

However, the coupling relationship between the pixels PXL and the scan lines S0 to Sn may be variously modified, as suitable, according to structures of the pixels PXL. For example, the pixels PXL located on the ith horizontal line may be coupled to the ith scan lines Si, the (i−1)th scan line Si−1, and an (i+1)th scan line Si+1.

The scan driver 110 may supply scan signals to the scan lines S0 to Sn in response to a scan driver control signal SCS supplied from the timing controller 160.

For example, the scan driver 110 may sequentially supply the scan signals to the scan lines S0 to Sn. When the scan signals are sequentially supplied to the scan lines S0 to Sn, the pixels PXL may be sequentially selected in units of horizontal lines.

In this case, the scan signal may have a voltage level that enables a transistor supplied with the scan signal to be turned on.

The emission driver 130 may supply emission control signals to the emission control lines E1 to En in response to an emission driver control signal ECS supplied from the timing controller 160.

For example, the emission driver 130 may sequentially supply emission control signals to the emission control lines E1 to En.

In this case, the emission control signal may have a voltage level that enables a transistor supplied with the emission control signal to be turned off.

The data driver 120 may supply data signals to the data lines D1 to Dm in response to a data driver control signal DCS.

The data signals supplied to the data lines D1 to Dm may be supplied to pixels PXL selected by each scan signal.

To this end, the data driver 120 may supply the data signals to the data lines D1 to Dm in synchronization with the scan signals.

The timing controller 160 may generate the data driver control signal DCS, the scan driver control signal SCS, and the emission driver control signal ECS in response to control signals supplied from the outside (e.g., from a source external to the display device 10).

In this case, the scan driver control signal SCS may be supplied to the scan driver 110, the data driver control signal DCS may be supplied to the data driver 120, and the emission driver control signal ECS may be supplied to the emission driver 130.

In addition, the timing controller 160 may convert image data input from the outside into image data Data suitable for specifications of the data driver 120, and supply the converted image data Data to the data driver 120.

The scan driver control signal SCS may include a scan start signal and clock signals. The scan start signal may control supply timings of the scan signals, and the clock signals may be used to shift the scan start signal.

The emission driver control signal ECS may include an emission start signal and clock signals. The emission start signal may control supply timings of the emission control signals, and the clock signals may be used to shift the emission start signal.

The data driver control signal DCS may include a source start signal, a source output enable signal, a source sampling clock, and the like. The source start signal may control a data sampling start time of the data driver 120. The source sampling clock may control a sampling operation of the data driver 120, based on a rising or falling edge. The source output enable signal may control an output timing of the data driver 120.

The (n+1) scan lines S0 to Sn and n emission control lines E1 to En are illustrated in FIG. 1; however, the present disclosure is not limited thereto. For example, dummy scan lines and/or dummy emission control lines may be additionally formed so as to achieve the stability of driving.

In FIG. 1, it is illustrated that the scan driver 110, the data driver 120, the emission driver 130, and the timing controller 160 are individually provided as separate blocks; however, at least some of the components may be integrated, if desired.

In addition, the scan driver 110, the data driver 120, the emission driver 130, and the timing controller 160 may be installed in various suitable ways including chip on glass, chip on plastic, tape carrier package, chip on film, and the like.

Figure 2:
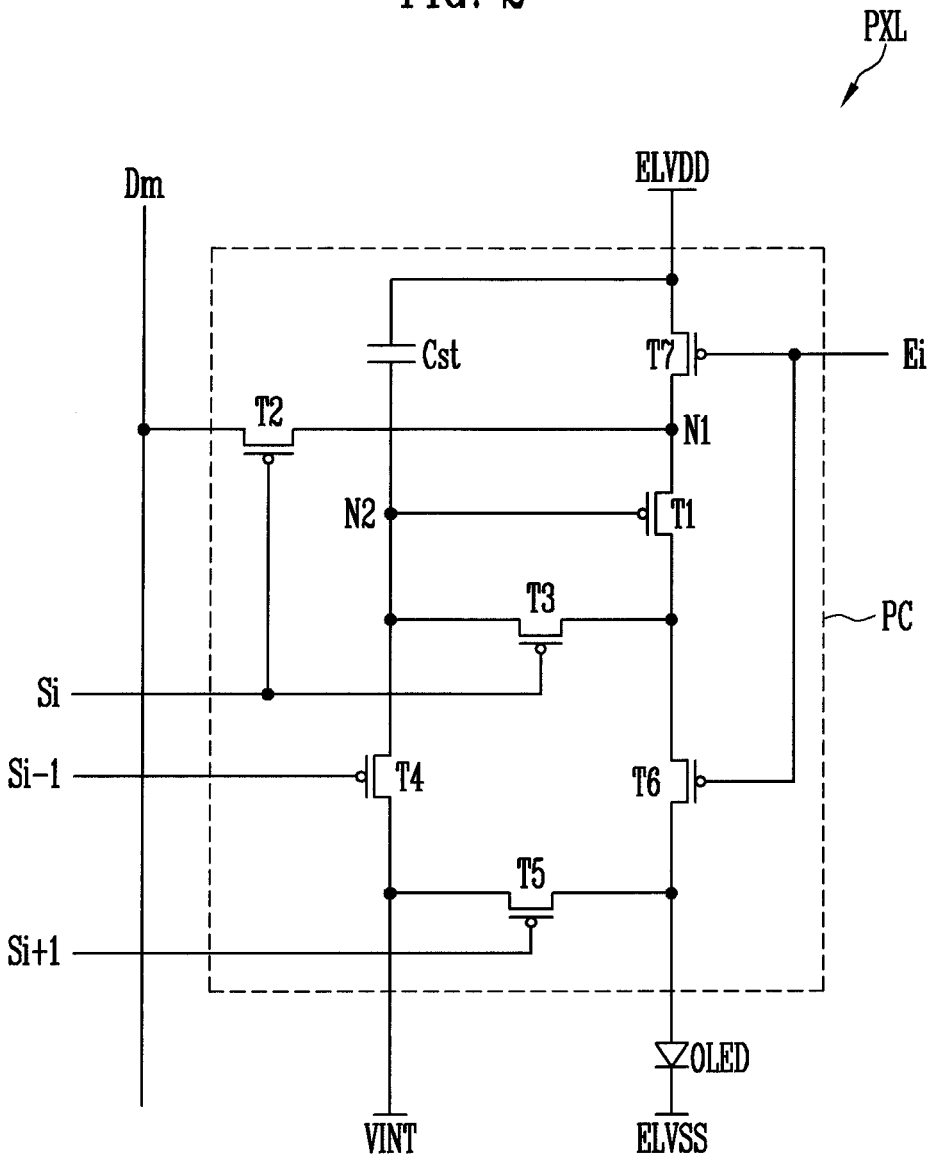
FIG. 2 is a circuit diagram illustrating a pixel according to an embodiment of the present disclosure.

FIG. 2 is a circuit diagram illustrating a pixel according to an embodiment of the present disclosure.

For convenience of description, a pixel PXL coupled to an ith (i is a natural number) emission control line Ei and an mth (m is a natural number) data line Dm is illustrated in FIG. 2.

Referring to FIG. 2, the pixel PXL according to an embodiment of the present disclosure may include a pixel circuit PC and an organic light emitting diode OLED.

An anode electrode of the organic light emitting diode OLED may be coupled to the pixel circuit PC, and a cathode electrode of the organic light emitting diode OLED may be coupled to the second pixel power source ELVSS.

The organic light emitting diode OLED may generate light with a set or predetermined luminance corresponding to a driving current supplied from the pixel circuit PC.

The first pixel power source ELVDD may be set to a voltage higher than that of the second pixel power source ELVSS such that a current can flow through the organic light emitting diode OLED.

The pixel circuit PC may control the amount of driving current flowing from the first pixel power source ELVDD to the second pixel power source ELVSS via the organic light emitting diode OLED, corresponding to a data signal. To this end, the pixel circuit PC may include a first transistor T1, a second transistor T2, a third transistor T3, a fourth transistor T4, a fifth transistor T5, at least one emission control transistor, and a storage capacitor Cst.

A first electrode of the first transistor (i.e., a driving transistor) T1 may be coupled to the first node N1, and a second electrode of the first transistor T1 may be coupled to a first electrode of a sixth transistor T6. In addition, a gate electrode of the first transistor T1 may be coupled to the second node N2. The first transistor T1 may control the amount of driving current flowing from the first pixel power source ELVDD to the second pixel power source ELVDD via the organic light emitting diode OLED, corresponding to a data signal supplied to the mth data line Dm.

The second transistor T2 may be coupled between the mth data line Dm and the first node N1. In other words, the second transistor T2 may be coupled to the first electrode of the first transistor T1 and the mth data line Dm.

In addition, a gate electrode of the second transistor T2 may be coupled to an ith scan line Si. The second transistor T2 may be turned on when a scan signal is supplied to the ith scan line Si, to allow the mth data line Dm and the first node N1 to be electrically coupled to each other.

The third transistor T3 may be coupled between the second electrode of the first transistor T1 and the second node N2. In other words, the third transistor T3 may be coupled between the gate electrode of the first transistor T1 and the second electrode of the first transistor T1.

In addition, a gate electrode of the third transistor T3 may be coupled to the ith scan line Si. The third transistor T3 may be turned on when the scan signal is supplied to the ith scan line Si, to allow the first transistor T1 to be diode-coupled.

The fourth transistor T4 may be coupled between the second node N2 and the third pixel power source VINT. In other words, the fourth transistor T4 may be coupled between the gate electrode of the first transistor T1 and the third pixel power source VINT.

In addition, a gate electrode of the fourth transistor T4 may be coupled to an (i−1)th scan line Si−1. The fourth transistor T4 may be turned on when a scan signal is supplied to the (i−1)th scan line Si−1, to supply the voltage of the third pixel power source VINT to the second node N2.

The fifth transistor T5 may be coupled between the anode electrode of the organic light emitting diode OLED and the third pixel power source VINT.

In addition, a gate electrode of the fifth transistor T5 may be coupled to an (i+1)th scan line Si+1. The fifth transistor T5 may be turned on when a scan signal is supplied to the (i+1)th scan line Si+1, to supply the voltage of the third pixel power source VINT to the anode electrode of the organic light emitting diode OLED.

In some embodiments, a gate electrode of the fifth transistor T5 may be coupled to the (i−1)th scan line Si−1 or the ith scan line Si.

The third pixel power source VINT may be set to a voltage lower than that of the data signal.

The emission control transistor may be located on a path of a driving current, and block the driving current, corresponding to an emission control signal supplied to the ith emission control line Ei.

For example, the emission control transistor may include the sixth transistor (i.e., a first emission control transistor) T6 and a seventh transistor (i.e., a second emission control transistor) T7.

The sixth transistor T6 may be coupled between the second electrode of the first transistor T1 and the anode electrode of the organic light emitting diode OLED. In addition, a gate electrode of the sixth transistor T6 may be coupled to the ith emission control line Ei. The sixth transistor T6 may be turned off when the emission control signal is supplied to the ith emission control line Ei, and be turned on when the emission control signal is not supplied.

The seventh transistor T7 may be coupled between the first pixel power source ELVDD and the first node N1. In other words, the seventh transistor T7 may be coupled between the first pixel power source ELVDD and the first electrode of the first transistor T1.

In addition, a gate electrode of the seventh transistor T7 may be coupled to the ith emission control line Ei. The seventh transistor T7 may be turned off when the emission control signal is supplied to the ith emission control line Ei, and be turned on when the emission control signal is not supplied.

The storage capacitor Cst may be coupled between the first pixel power source ELVDD and the second node N2. In other words, the storage capacitor Cst may be coupled between the first pixel power source ELVDD and the gate electrode of the first transistor T1.

The storage capacitor Cst may store a voltage corresponding to the data signal and the threshold voltage of the first transistor T1.

In the present disclosure, the organic light emitting diode OLED may generate various suitable light colors including red, green, and blue, corresponding to the amount of current supplied from the driving transistor; however, the present disclosure is not limited thereto. For example, the organic light emitting diode OLED may generate white light, corresponding to the amount of current supplied from the driving transistor. In this case, a color image can be implemented using a separate color filter, or the like.

Figure 3:
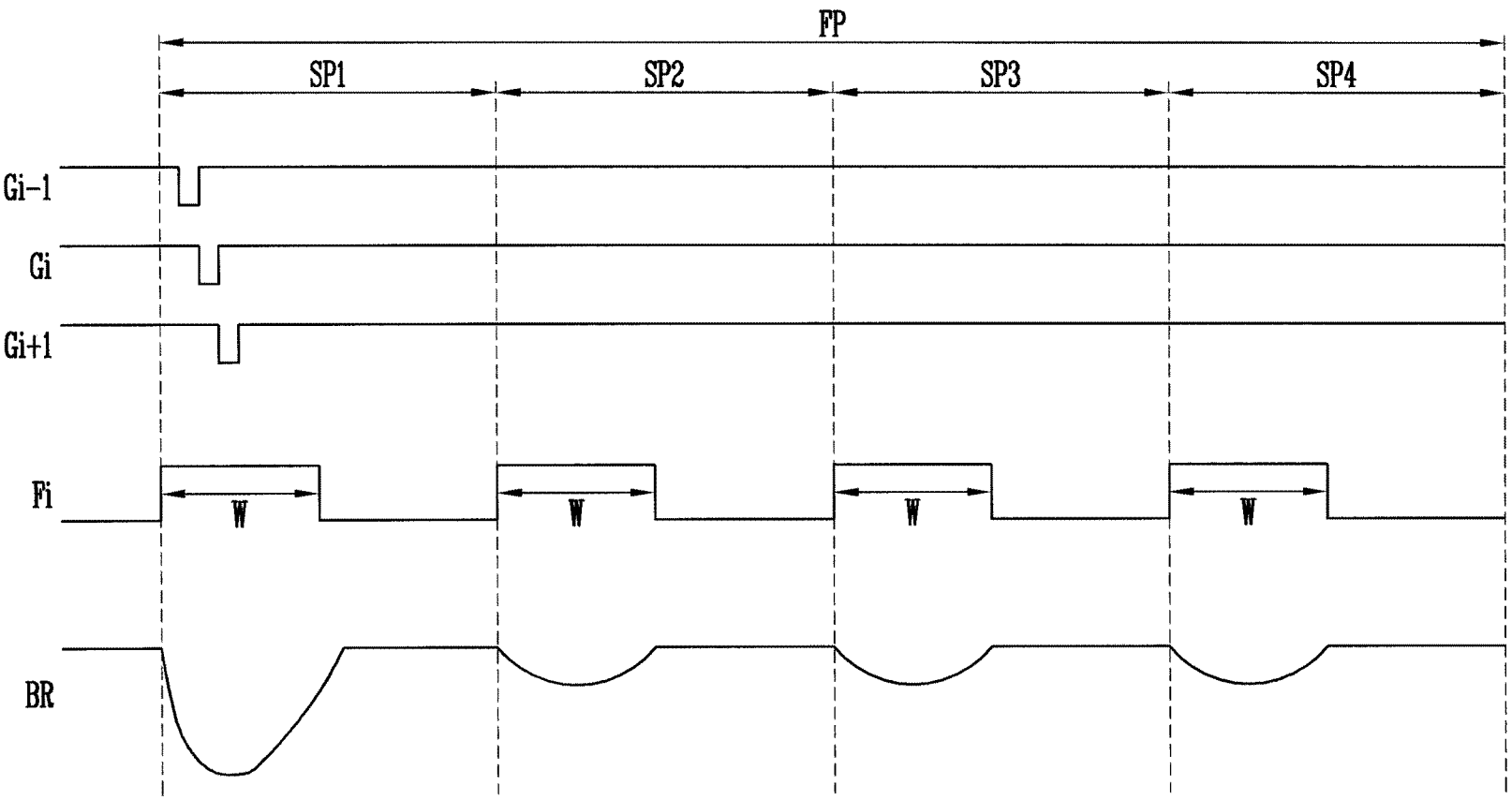
FIG. 3 is a waveform diagram illustrating an emission control method of adjusting luminance by controlling the entire supply period of emission control signals during one frame period.

FIG. 3 is a waveform diagram illustrating an emission control method of adjusting luminance by controlling the entire supply period of emission control signals during one frame period. In particular, during one frame period FP, a scan signal Gi−1 supplied to the (i−1)th scan line Si−1, a scan signal Gi supplied to the ith scan line Si, a scan signal Gi+1 supplied to the (i+1)th scan line Si+1, an emission control signal Fi supplied to the ith emission control line Ei are illustrated in FIG. 3.

Referring to FIG. 3, the one frame period FP may include a plurality of sub-periods SP1, SP2, SP3, and SP4.

For example, the one frame period FP may include a first sub-period SP1, a second sub-period SP2, a third sub-period SP3, and a fourth sub-period SP4.

In this case, the emission control signal Fi for controlling the non-emission period of the pixel PXL may be supplied in each sub-period SP1, SP2, SP3, or SP4, and the entire supply period (or duty cycle) of the emission control signals is controlled during the one frame period FP, so that the emission time and emission amount of the pixel PXL can be controlled.

That is, when the width W of each emission control signal Fi is decreased, the luminance of the pixel PXL may be increased. When the width W of each emission control signal Fi is increased, the luminance of the pixel PXL may be decreased.

However, the width W of the emission control signal Fi supplied during each sub-period SP1, SP2, SP3, and SP4 may be constant. In this case, there may occur a difference luminance BR between the sub-periods SP1, SP2, SP3, and SP4.

This is because the anode electrode of the organic light emitting diode OLED is initialized to the voltage of the third pixel power source VINT due to the scan signal Gi+1 supplied to the (i+1)th scan line in the first sub-period SP1; however, the initialization of the organic light emitting diode OLED is not performed in the other sub-periods SP2, SP3, and SP4. In addition, such a phenomenon is further noticeable in low gray level expression. This is because a charging delay of the organic light emitting diode OLED is remarkably exhibited due to a low driving current in the low gray level expression.

The difference in luminance BR between the sub-periods SP1, SP2, SP3, and SP4 may cause a flicker phenomenon.

Figure 4:
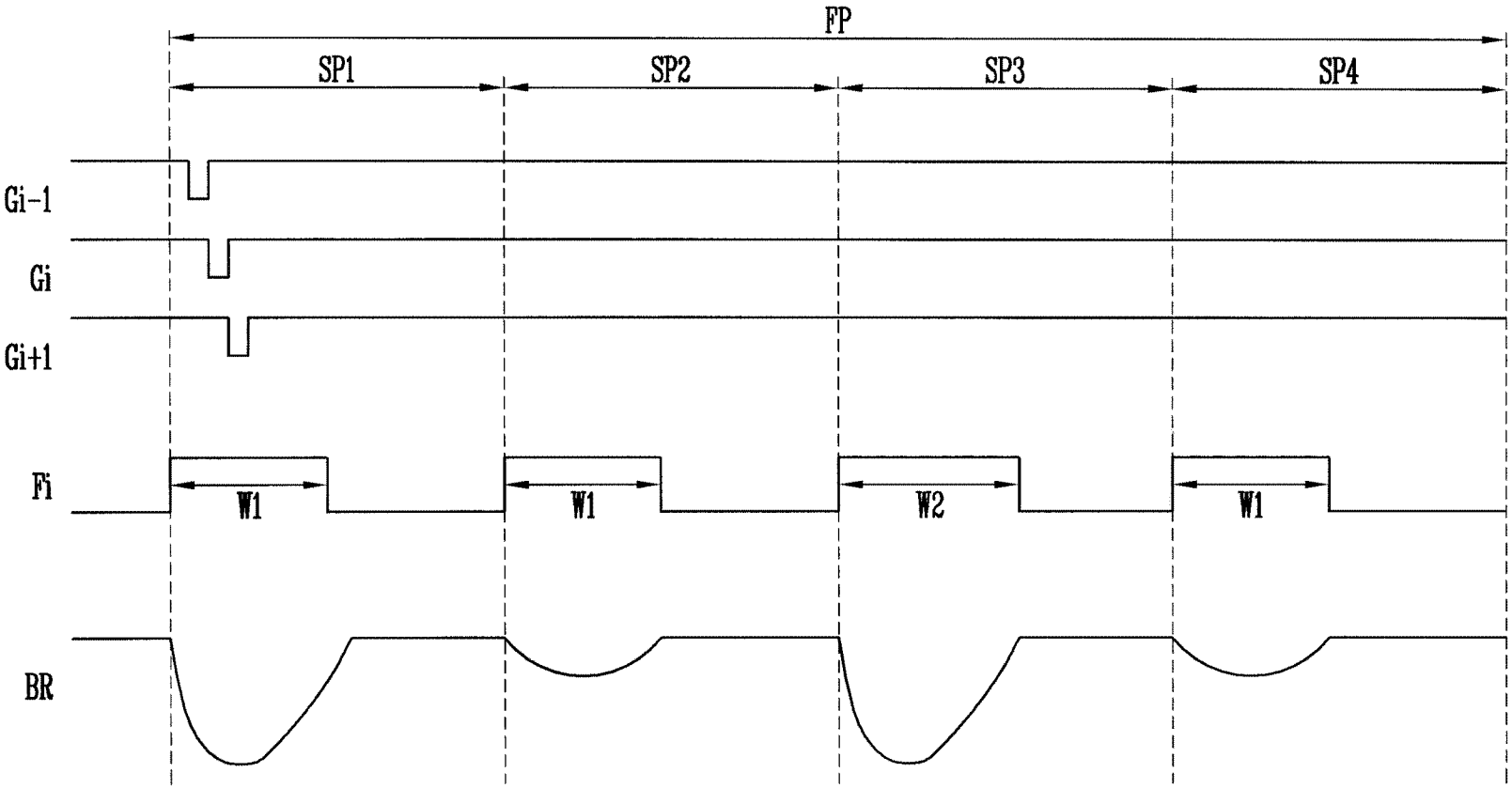
FIG. 4 is a waveform diagram illustrating an operation of the pixel according to an embodiment of the present disclosure.

FIG. 4 is a waveform diagram illustrating an operation of the pixel according to an embodiment of the present disclosure. In particular, during one frame period FP, a scan signal Gi−1 supplied to the (i−1)th scan line Si−1, a scan signal Gi supplied to the ith scan line Si, a scan signal Gi+1 supplied to the (i+1)th scan line Si+1, an emission control signal Fi supplied to the ith emission control line Ei are illustrated in FIG. 4.

Referring to FIG. 4, the one frame period FP may include a plurality of sub-periods SP1, SP2, SP3, and SP4.

For example, the one frame period FP may include a first sub-period SP1, a second sub-period SP2, a third sub-period SP3, and a fourth sub-period SP4.

In the first sub-period SP1, the emission control signal Fi is first supplied to the ith emission control line Ei. When the emission control signal Fi is supplied to the ith emission control line Ei, the sixth transistor T6 and the seventh transistor T7, which are emission control transistors, may be turned off. In this case, the pixel PXL may be set to a non-emission state.

Subsequently, the scan signal Gi−1 is supplied to the (i−1)th scan line Si−1 such that the fourth transistor T4 is turned on. When the fourth transistor T4 is turned on, the voltage of the third pixel power source VINT may be supplied to the second node N2. Then, the second node N2 may be initialized to the voltage of the third pixel power source VINT.

After the second node N2 is initialized to the voltage of the third pixel power source VINT, the scan signal Gi is supplied to the ith scan line Si. When the scan signal Gi is supplied to the ith scan line Si, the second transistor T2 and the third transistor T3 may be turned on.

When the third transistor T3 is turned on, the first transistor T1 may be diode-coupled.

When the second transistor T2 is turned on, a data signal from the mth data line Dm may be supplied to the first electrode of the first transistor T1 (e.g., the first node N1). At this time, because the second node N2 is initialized to the voltage of the third pixel power source VINT, which is lower than that of the data signal, the first transistor T1 may be turned on. When the first transistor T1 is turned on, a voltage obtained by subtracting the threshold voltage of the first transistor T1 from the data signal is applied to the second node N2. The storage capacitor Cst stores a voltage corresponding to the data signal applied to the second node N2 and the threshold voltage of the first transistor T1.

Subsequently, the scan signal Gi+1 is supplied to the (i+1)th scan line Si+1. When the scan signal Gi+1 is supplied to the (i+1)th scan line Si+1, the fifth transistor T5 may be turned on.

When the fifth transistor T5 is turned on, the voltage of the third pixel power source VINT is supplied to the anode electrode of the organic light emitting diode OLED. Then, a parasitic capacitor parasitically formed in the organic light emitting diode OLED is discharged, and accordingly, the black expression ability (e.g., the ability to express a deep black) of the pixel PXL can be improved.

After that, the supply of the emission control signal Fi to the ith emission control line Ei is stopped. When the supply of the emission control signal Fi to the ith emission control line Ei is stopped, the sixth transistor T6 and the seventh transistor T7 may be turned on. Then, there is formed a current path extending from the first pixel power source ELVDD to the second pixel power source ELVSS via the seventh transistor T7, the first transistor T1, the sixth transistor T6, and the organic light emitting diode OLED.

At this time, the first transistor T1 controls the amount of driving current flowing the first pixel power source ELVDD to the second pixel power source ELVSS via the organic light emitting diode OLED, corresponding to the voltage of the second node N2. The organic light emitting diode OLED generates light with a set or predetermined luminance corresponding to the amount of current supplied from the first transistor T1.

During the second sub-period SP2, the emission control signal Fi may be again supplied to the ith emission control line Ei.

In this case, because the sixth transistor T6 and the seventh transistor T7 are turned off, the driving current is blocked, and accordingly, the pixel PXL may be set to the non-emission state.

When the supply of the emission control signal Fi is stopped, the sixth transistor T6 and the seventh transistor T7 are turned on, and therefore, the pixel PXL may be again set to an emission state.

Like the second sub-period SP2 described above, the supply of the emission control signal Fi may be performed in the third sub-period SP3 and the fourth sub-period SP4.

However, in an embodiment of the present disclosure, the width of the emission control signal Fi supplied in any one sub-period among the sub-periods SP1, SP2, SP3, and SP4 may be set differently from that of the emission control signal Fi supplied in another sub-period so as to remove a difference in luminance between the sub-periods SP1, SP2, SP3, and SP4.

In this case, because the emission control signal Fi is supplied for each of the sub-period SP1, SP2, SP3, and SP4 as described above, the sixth transistor T6 and the seventh transistor T7 may be turned off for each of the sub-period SP1, SP2, SP3, and SP4.

In addition, an off period of the sixth transistor T6 and the seventh transistor T7 in any one sub-period among the sub-periods SP1, SP2, SP3, and SP4 may be different from that of the sixth transistor T6 and the seventh transistor T7 in another sub-period.

For example, a width W2 of the emission control signal Fi supplied in the third sub-period SP3 may be set differently from that W1 of the emission control signal Fi supplied in the first sub-period SP1, the second sub-period SP2, and the fourth sub-period SP4.

For example, the width W2 of the emission control signal Fi supplied in the third sub-period SP3 may be set wider than that W1 of the emission control signal Fi supplied in the first sub-period SP1, the second sub-period SP2, and the fourth sub-period SP4.

In this case, an off period of the sixth transistor T6 and the seventh transistor T7 in the third sub-period SP3 is longer than that of the sixth transistor T6 and the seventh transistor T7 in the first sub-period SP1, the second sub-period SP2, and the fourth sub-period SP4.

Thus, a pixel luminance BR in the third sub-period SP3 can be implemented similarly to that BR in the first sub-period SP1, and accordingly, the above-described flicker phenomenon can be reduced.

In particular, when the width W2 of the emission control signal Fi supplied in the third sub-period SP3 is set wide, regularity (or repeatability) may be provided to the pixel luminance BR. Thus, the flicker phenomenon will be further reduced.

In another embodiment, it may be considered to change the width of the emission control signal Fi supplied in the second sub-period SP2 or the fourth sub-period SP4.

In addition, the width of the emission control signal Fi supplied in each of the second sub-period SP2, the third sub-period SP3, and the fourth sub-period SP4 may be set wider than that of the emission control signal Fi supplied in the first sub-period SP1.

Figure 5:
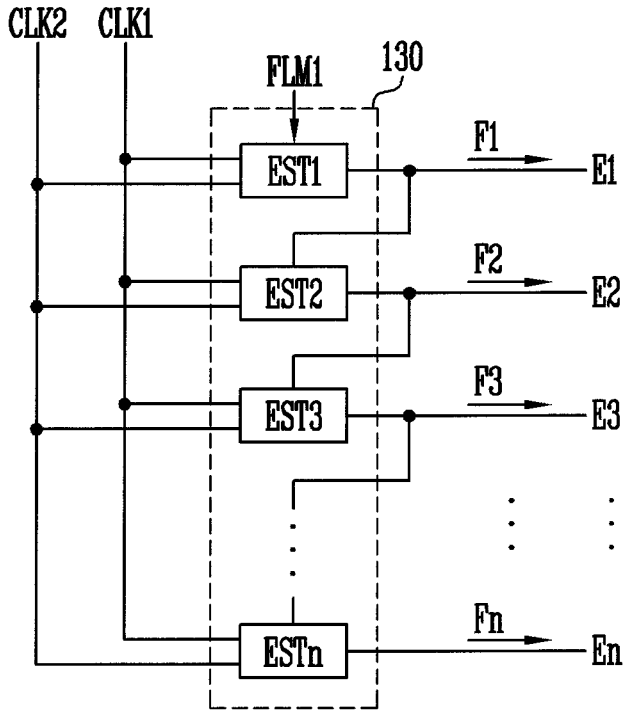
FIG. 5 is a block diagram illustrating, in further detail, an emission driver shown in FIG. 1.

FIG. 5 is a block diagram illustrating, in further detail, the emission driver shown in FIG. 1.

Referring to FIG. 5, the emission driver 130 may include a plurality of emission stage circuits EST1 to ESTn.

The emission stage circuits EST1 to ESTn may be coupled to one ends of the emission control lines E1 to En, respectively. Accordingly, the emission stage circuits EST1 to ESTn may supply emission control signals F1 to Fn to the emission control lines E1 to En, respectively.

In this case, the emission stage circuits EST1 to ESTn may be operated corresponding to clock signals CLK1 and CLK2 supplied from the timing controller 160. Also, the emission state circuits EST1 to ESTn may be implemented as the same or substantially the same circuit.

Each of the emission stage circuits EST1 to ESTn may be supplied with an output signal (i.e., an emission control signal) of a previous emission stage circuit thereof or an emission start signal FLM.

For example, a first emission stage circuit EST1 may be supplied with the emission start signal FLM, and each of the other emission stage circuits EST2 to ESTn may be supplied with an output signal of a previous emission stage circuit thereof.

The width of the emission control signals F1 to Fn may be determined corresponding to the width of the emission start signal FLM. In other words, as the width of the emission start signal FLM is widened, the width of the emission control signals F1 to Fn may be widened.

Figure 6:
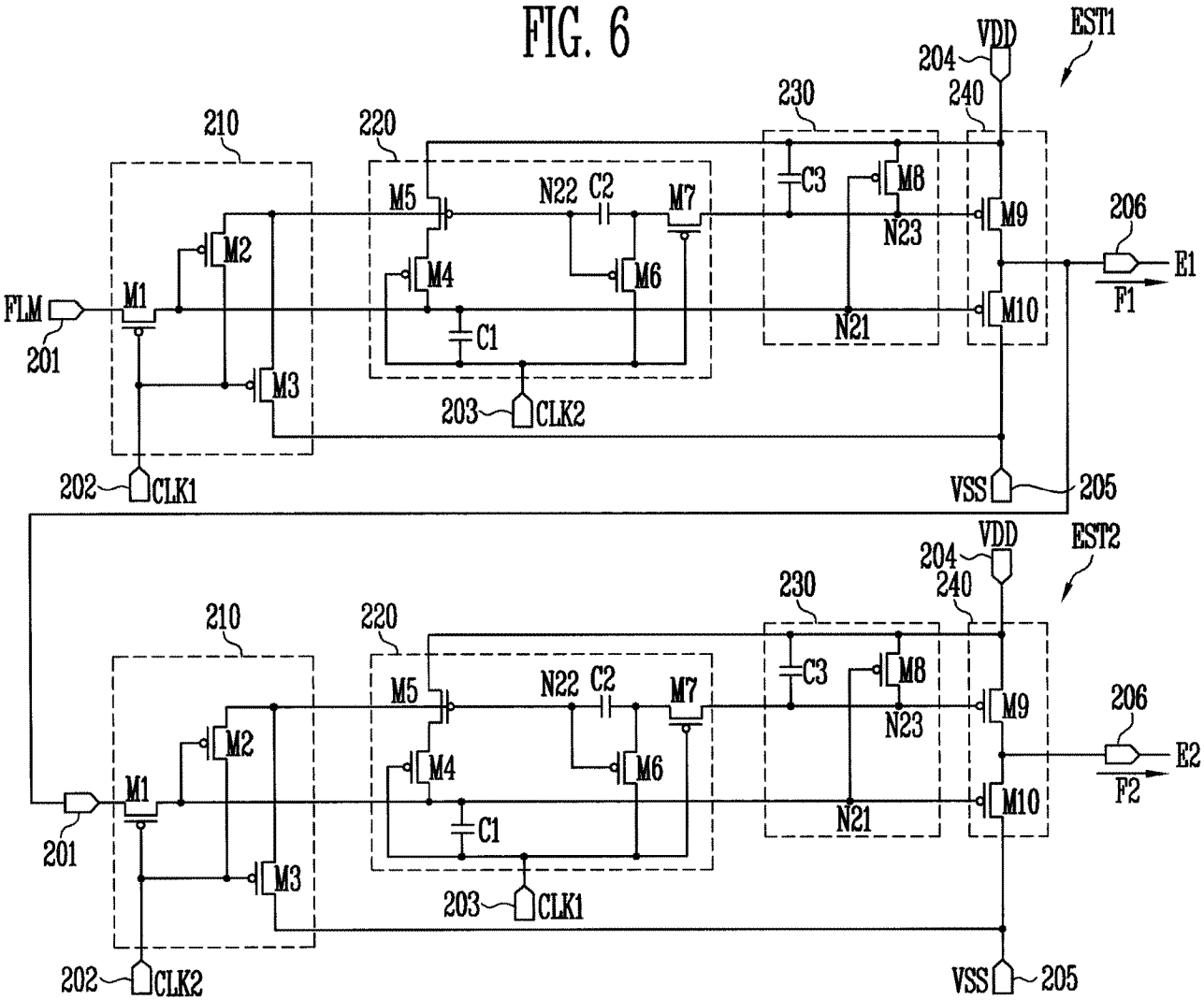
FIG. 6 is a circuit diagram illustrating emission stage circuits according to an embodiment of the present disclosure.

FIG. 6 is a circuit diagram illustrating the emission stage circuits according to an embodiment of the present disclosure.

For convenience of description, first and second emission stage circuits EST1 and EST2 of the emission driver 130 are illustrated in FIG. 6.

Referring to FIG. 6, the first emission stage circuit EST1 may include a first driving circuit 210, a second driving circuit 220, a third driving circuit 230, and an output unit 240.

The first driving circuit 210 may control voltages of a second node N22 and a first node N21, corresponding to signals supplied to a first input terminal 201 and a second input terminal 202. To this end, the first driving circuit 210 may include first to third transistors M1 to M3.

The first transistor M1 may be coupled between the first input terminal 201 and the first node N21, and a gate electrode of the first transistor M1 may be coupled to the second input terminal 202. The first transistor M1 may be turned on corresponding to a first clock signal CLK1 supplied to the second input terminal 202.

The second transistor M2 may be coupled between the second input terminal 202 and the second node N22, and a gate electrode of the second transistor M2 may be coupled to the first node N21. The second transistor M2 may be turned on or turned off corresponding to the voltage of the first node N21.

The third transistor M3 may be coupled between a fifth input terminal 205 supplied with a second driving power source VSS and the second node N22, and a gate electrode of the third transistor M3 may be coupled to the second input terminal 202. The third transistor M3 may be turned on corresponding to the first clock signal CLK1 supplied to the second input terminal 202.

The second driving circuit 220 may control the voltage of the first node N21 and a voltage of a third node N23, corresponding to a signal supplied to a third input terminal 203 and the voltage of the second node N22. To this end, the second driving circuit 220 may include fourth to seventh transistors M4 to M7, a first capacitor C1, and a second capacitor C2.

The fourth transistor M4 may be coupled between the fifth transistor M5 and the first node N21, and a gate electrode of the fourth transistor M4 may be coupled to the third input terminal 203. The fourth transistor M4 may be turned on corresponding to a second clock signal CLK2 supplied to the third input terminal 203.

The fifth transistor M5 may be coupled between a fourth input terminal 204 supplied with a first driving power source VDD and the fourth transistor M4, and a gate electrode of the fifth transistor M5 may be coupled to the second node N22. The fifth transistor M5 may be turned on or turned off corresponding to the voltage of the second node N22.

The sixth transistor M6 may be coupled between a first electrode of the seventh transistor M7 and the third input terminal 203, and a gate electrode of the sixth transistor M6 may be coupled to the second node N22. The sixth transistor M6 may be turned on or turned off corresponding to the voltage of the second node N22.

The seventh transistor M7 may be coupled between a first electrode of the sixth transistor M6 and the third node N23, and a gate electrode of the seventh transistor M7 may be coupled to the third input terminal 203. The seventh transistor M7 may be turned on corresponding to the second clock signal CLK2 supplied to the third input terminal 203.

The first capacitor C1 may be coupled between the first node N21 and the third input terminal 203.

The second capacitor C2 may be coupled between the second node N22 and the first electrode of the seventh transistor M7.

The third driving circuit 230 may control the voltage of the third node N23, corresponding to the voltage of the first node N21. To this end, the third driving circuit 230 may include an eighth transistor M8 and a third capacitor C3.

The eighth transistor M8 may be coupled between the fourth input terminal 204 supplied with the first driving power source VDD and the third node N23, and a gate electrode of the eighth transistor M8 may be coupled to the first node N21. The eighth transistor M8 may be turned on or turned off corresponding to the voltage of the first node N21.

The third capacitor C3 may be coupled between the fourth input terminal 204 supplied with the first driving power source VDD and the third node N23.

The output unit 240 may control a voltage supplied to an output terminal 206, corresponding to the voltages of the first node N21 and the third node N23. To this end, the output unit 240 may include a ninth transistor M9 and a tenth transistor M10.

The ninth transistor M9 may be coupled between the fourth input terminal 204 supplied with the first driving power source VDD and the output terminal 206, and a gate electrode of the ninth transistor M9 may be coupled to the third node N23. The ninth transistor M9 may be turned on or turned off corresponding to the voltage of the third node N23.

The tenth transistor M10 may be coupled between the output terminal 206 and the fifth input terminal 205 supplied with the second driving power source VSS, and a gate electrode of the tenth transistor M10 may be coupled to the first node N21. The tenth transistor M10 may be turned on or turned off corresponding to the voltage of the first node N21.

The second emission stage circuit EST2 and the other emission stage circuits EST3 to ESTn may have the same or substantially the same configuration as the first emission state circuit EST1.

A second input terminal 202 of a jth emission stage circuit ESTj may be supplied with the first clock signal CLK1, and a third input terminal 203 of the jth emission stage circuit ESTj may be supplied with the second clock signal CLK2. A second input terminal 202 of a (j+1)th emission stage circuit ESTj+1 may be supplied with the second clock signal CLK2, and a third input terminal 203 of the (j+1)th emission stage circuit ESTj+1 may be supplied with the first clock signal CLK1.

The first clock signal CLK1 and the second clock signal CLK2 have the same or substantially the same period and have phases that do not overlap with each other. For example, the clock signals CLK1 and CLK2 may have a period of 2H and be supplied in different horizontal periods.

Figure 7:
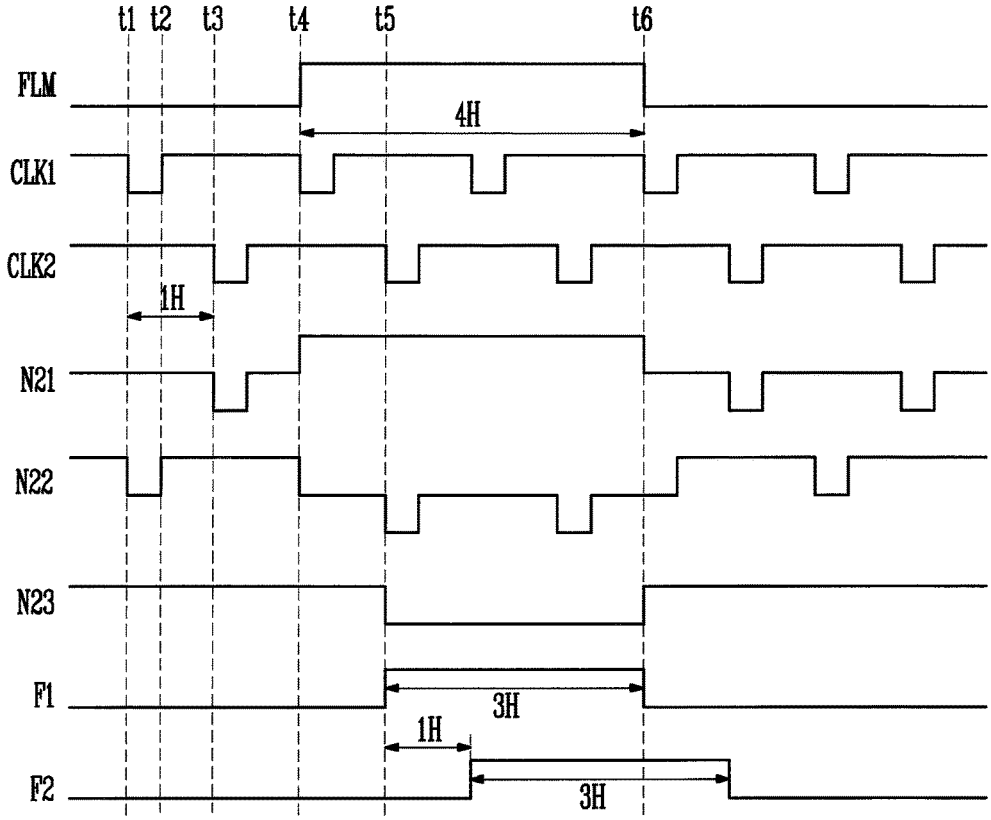
FIG. 7 is a waveform diagram illustrating a driving method of the emission stage circuit shown in FIG. 6.

FIG. 7 is a waveform diagram illustrating a driving method of the emission stage circuit shown in FIG. 6. In FIG. 7, for convenience of illustration, an operating process will be described using the first emission stage circuit EST1.

Referring to FIG. 7, the clock signals CLK1 and CLK2 may have a period of two horizontal periods 2H and be supplied in different horizontal periods. In addition, the second clock signal CLK2 may be set as a signal shifted by a half period (i.e., one horizontal period 1H) in the first clock signal CLK1.

When the emission start signal FLM is supplied, the first input terminal 201 may be set to the voltage of the first driving power source VDD. When the emission start signal FLM is not supplied, the first input terminal 201 may be set to the voltage of the second driving power source VSS. In addition, when the clock signal CLK is supplied to the second input terminal 202 and the third input terminal 203, the second input terminal 202 and the third input terminal 203 may be set to the voltage of the second driving power source VSS. When the clock signal CLK is not supplied to the second input terminal 202 and the third input terminal 203, the second input terminal 202 and the third input terminal 203 may be set to the voltage of the first driving power source VDD.

The emission start signal FLM supplied to the first input terminal 201 may be supplied to be synchronized with the clock signal supplied to the second input terminal 202, i.e., the first clock signal CLK1. In addition, the emission start signal FLM may be set to have a width wider than that of the first clock signal CLK1. For example, the emission start signal FLM may be supplied during four horizontal periods 4H.

The operating process will be described in further detail. First, at a first time t1, the first clock signal CLK1 may be supplied to the second input terminal 202. When the first clock signal CLK1 is supplied to the second input terminal 202, the first transistor M1 and the third transistor M3 may be turned on.

When the first transistor M1 is turned on, the first input terminal 201 and the first node N21 may be electrically coupled to each other. At this time, because the emission start signal FLM is not supplied to the first input terminal 201, a low-level voltage may be supplied to the first node N21.

When the low-level voltage is supplied to the first node N21, the second transistor M2, the eighth transistor M8, and the tenth transistor M10 may be turned on.

When the eighth transistor M8 is turned on, the first driving power source VDD is supplied to the third node N23, and accordingly, the ninth transistor M9 can be turned off.

At this time, the third capacitor C3 charges a voltage corresponding to that of the first driving power source VDD, and accordingly, the ninth transistor M9 can stably maintain a turn-off state even after the first time t1.

When the tenth transistor M10 is turned on, the voltage of the second driving power source VSS may be supplied to the output terminal 206. Therefore, the emission control signal F1 is not supplied to the first emission control line E1 at the first time t1.

When the second transistor M2 is turned on, the first clock signal CLK1 may be supplied to the second node N22. In addition, when the third transistor M3 is turned on, the voltage of the second driving power source VSS may be supplied to the second node N22. Here, the first clock signal CLK1 is set to the voltage of the second driving power source VSS, and accordingly, the second node N22 can be stably set to the voltage of the second driving power source VSS. When the voltage of the second node N22 is set as that of the second driving power source VSS, the seventh transistor M7 may be set to the turn-off state. Thus, the third node N23 can maintain the voltage of the first driving power source VDD regardless of the voltage of the second node N22.

At a second time t2, the supply of the first clock signal CLK1 to the second input terminal 202 may be stopped. When the supply of the first clock signal CLK1 is stopped, the first transistor M1 and the third transistor M3 may be turned off. At this time, the voltage of the first node N21 is maintained as a low-level voltage by the first capacitor C1, and accordingly, the second transistor M2, the eighth transistor M8, and the tenth transistor M10 can maintain a turn-on state.

When the second transistor M2 is turned on, the second input terminal 202 and the second node N22 may be electrically coupled to each other. In this case, the second node N22 may be set to a high-level voltage.

When the eighth transistor M8 is turned on, the voltage of the first driving power source VDD is supplied to the third node N23, and accordingly, the ninth transistor M9 can maintain the turn-off state.

When the tenth transistor M10 is turned on, the voltage of the second driving power source VSS may be supplied to the output terminal 206.

At a third time t3, the second clock signal CLK2 may be supplied to the third input terminal 203. When the second clock signal CLK2 is supplied to the third input terminal 203, the fourth transistor M4 and the seventh transistor M7 may be turned on.

When the seventh transistor M7 is turned on, the second capacitor C2 and the third node N23 may be electrically coupled to each other. In this case, the third node N23 may maintain the voltage of the first driving power source. At this time, because the fifth transistor M5 is set to the turn-off state when the fourth transistor M4 is turned on, the voltage of the first node N21 is not changed even when the fourth transistor M4 is turned on.

When the second clock signal CLK2 is supplied to the third input terminal 203, the voltage of the first node 21 may drop to a voltage lower than that of the second driving power source VSS due to coupling of the first capacitor C1. When the voltage of the first node N21 drops to a voltage lower than that of the second driving power source VSS, driving characteristics of the eighth transistor M8 and the tenth transistor M10 can be improved.

At a fourth time t4, the emission start signal FLM may be supplied to the first input terminal 201, and the first clock signal CLK1 may be supplied to the second input terminal 202.

When the first clock signal CLK1 is supplied to the second input terminal 202, the first transistor M1 and the third transistor M3 may be turned on. v the first transistor M1 is turned on, the first input terminal 201 and the first node N21 may be electrically coupled to each other. At this time, because the emission start signal FLM is supplied to the first input terminal 201, a high-level voltage may be supplied to the first node N21. When the high-level voltage is supplied to the first node N21, the second transistor M2, the eighth transistor M8, and the tenth transistor M10 may be turned off.

When the third transistor M3 is turned on, the voltage of the second driving power source VSS may be supplied to the second node N22. At this time, because the fourth transistor M4 is set to the turn-off state, the voltage of the first node N21 may be maintained as the high-level voltage. In addition, because the seventh transistor M7 is set to the turn-off state, the voltage of the third node N23 may be maintained as a high-level voltage. Thus, the ninth transistor M9 can maintain the turn-off state.

At a fifth time t5, the second clock signal CLK2 may be supplied to the third input terminal 203. When the second clock signal CLK2 is supplied to the third input terminal 203, the fourth transistor M4 and the seventh transistor M7 may be turned on. In addition, because the second node N22 is set to the voltage of the second driving power source VSS, the fifth transistor M5 and the sixth transistor M6 may be turned on.

When the sixth transistor M6 and the seventh transistor M7 are turned on, the second clock signal CLK2 may be supplied to the third node N23. When the second clock signal CLK2 is supplied to the third node N23, the ninth transistor M9 may be turned on. When the ninth transistor M9 is turned on, the voltage of the first driving power source VDD is supplied to the output terminal 206. The voltage of the first driving power source VDD, which is supplied to the output terminal 206, may be supplied as an emission control signal Fi to the first emission control line E1.

When the voltage of the second clock signal CLK2 is supplied to the third node N23, the voltage of the second node N22 drops to a voltage lower than that of the second driving power source VSS due to coupling of the second capacitor C2, and accordingly, driving characteristics of the transistors coupled to the second node N22 can be improved.

When the fourth transistor M4 and the fifth transistor M5 are turned on, the voltage of the first driving power source VDD may be supplied to the first node N21. The voltage of the first driving power source VDD is supplied to the first node N21, and accordingly, the tenth transistor M10 can maintain the turn-off state. Thus, the voltage of the first driving power source VDD can be stably supplied to the first emission control line E1.

At a sixth time t6, the first clock signal CLK1 may be supplied to the second input terminal 202. When the first clock signal CLK1 is supplied to the second input terminal 202, the first transistor M1 and the third transistor M3 may be turned on.

When the first transistor M1 is turned on, the first node N21 and the first input terminal 201 are electrically coupled to each other, and accordingly, the first node N21 may be set to a low-level voltage. When the first node N21 is set to the low-level voltage, the eighth transistor M8 and the tenth transistor M10 may be turned on.

When the eighth transistor M8 is turned on, the voltage of the first driving power source VDD is supplied to the third node N23, and accordingly, the ninth transistor M9 may be turned on. When the tenth transistor M10 is turned on, the voltage of the second driving power source VSS may be supplied to the output terminal 206. The voltage of the second driving power source VSS, which is supplied to the output terminal 206, is supplied to the first emission control line E1, and accordingly, the supply of the emission control signal Fi may be stopped.

The emission stage circuits EST1 to ESTn of the present disclosure can sequentially output the emission control signals F1 to Fn to the emission control lines E1 to En while repeating the above-described process.

Figure 8:
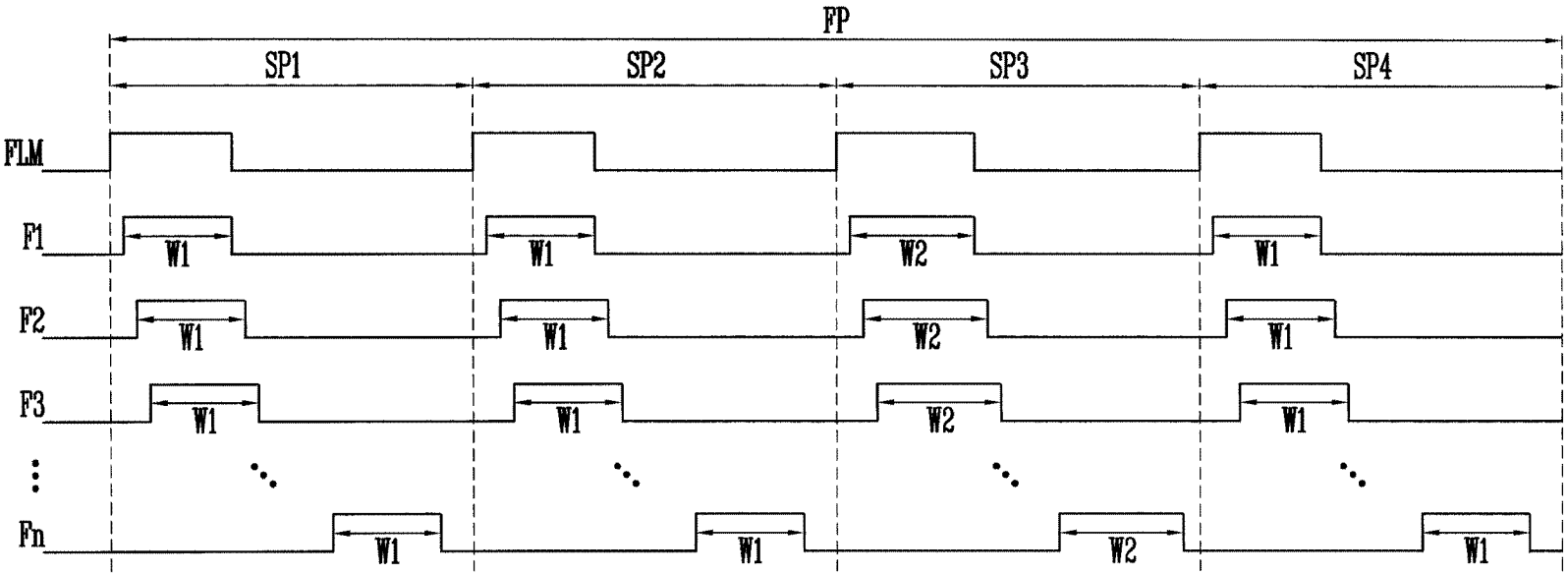
FIG. 8 is a waveform diagram illustrating an operation of the emission driver according to an embodiment of the present disclosure.

FIG. 8 is a waveform diagram illustrating an operation of the emission driver according to an embodiment of the present disclosure. In particular, an operation of the emission driver 130 during one frame period FP is illustrated in FIG. 8.

The one frame period FP may include a plurality of sub-periods SP1, SP2, SP3, and SP4.

For example, the one frame period FP may include a first sub-period SP1, a second sub-period SP2, a third sub-period SP3, and a fourth sub-period SP4.

The emission driver 130 may supply the emission control signals F1 to Fn during each of the sub-periods SP1, SP2, SP3, and SP4, corresponding to the emission control signal FLM.

In this case, the emission driver 130 may supplied the emission control signals F1 to Fn having a first signal width W1 or a second signal width W2 to the emission control lines E1 to En.

In this case, the second signal width W2 may be set as a width wider than the first signal width W1.

For example, the emission driver 130 may supply the emission control signals F1 to Fn having the first signal width W1 during the first sub-period SP1, the second sub-period SP2, and the fourth sub-period SP4, and supply the emission control signals F1 to Fn having the second signal width W2 during the third sub-period SP3.

In another embodiment, a signal width of the emission control signals F1 to Fn supplied in the second sub-period SP2 or the fourth sub-period SP4 may be set as the second signal width W2. In addition, signal widths of the emission control signals F1 to Fn supplied in the second sub-period SP2, the third sub-period SP3, and the fourth sub-period SP4 may be entirely set as the second width W2.

As described above, the signal width of the emission control signals F1 to Fn is differently set in each of the sub-periods SP1, SP2, SP3, and SP4, so that the flicker phenomenon can be reduced.

Figure 9:
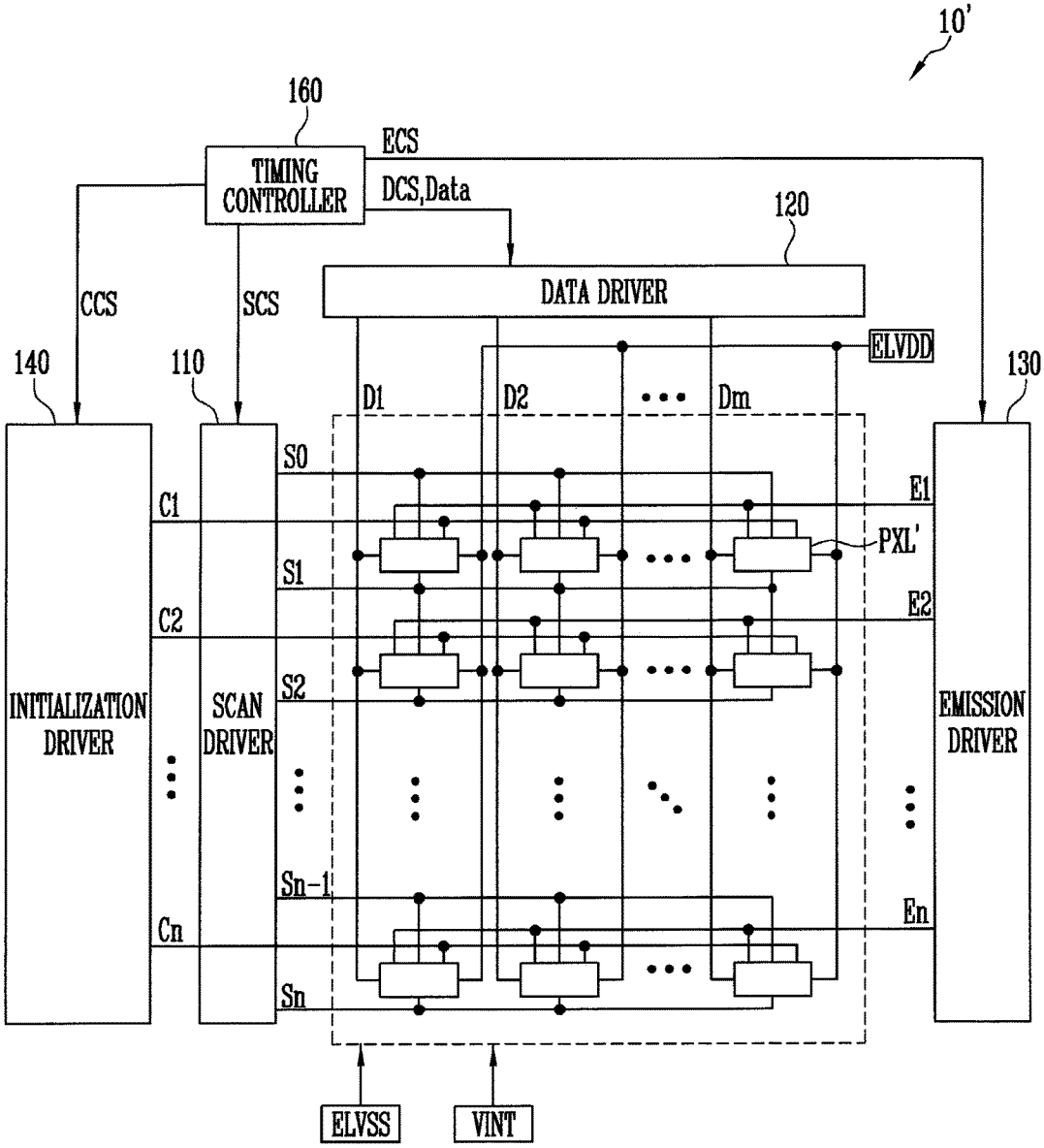
FIG. 9 is a block diagram illustrating a display device according to another embodiment of the present disclosure.

FIG. 9 is a block diagram illustrating a display device according to another embodiment of the present disclosure.

Referring to FIG. 9, the display device 10' according to an embodiment of the present disclosure may include pixels PXL', a scan driver 110, a data driver 120, an emission driver 130, an initialization driver 140, and a timing controller 160.

The pixels PXL' may be coupled to scan lines S0 to Sn, emission control lines E1 to En, initialization line C1 to Cn, and data lines D1 to Dm.

Also, the pixels PXL' may be coupled to a first pixel power source ELVDD, a second pixel power source ELVSS, and a third pixel power source VINT.

The pixels PXL' may be supplied with scan signals from the scan lines S0 to Sn, and be supplied with data signals synchronized with the scan signals from the data lines D1 to Dm.

Each of the pixels PXL' supplied with the data signals may control the amount of driving current flowing from the first pixel power source ELVDD to the second pixel power source ELVSS via an organic light emitting diode. In this case, the organic light emitting diode may generate light with a luminance corresponding to the amount of the driving current.

In addition, each of the pixels PXL' may be coupled to a plurality of scan lines. For example, each of the pixels PXL' may be coupled to a current scan line and a previous scan line.

For example, pixels PXL' located on an ith horizontal line may be coupled to an ith scan line Si and an (i−1)th scan line Si−1.

The scan driver 110 may supply scan signals to the scan lines S0 to Sn in response to a scan driver control signal SCS supplied from the timing controller 160.

For example, the scan driver 110 may sequentially supply the scan signals to the scan lines S0 to Sn. When the scan signals are sequentially supplied to the scan lines S0 to Sn, the pixels PXL' may be sequentially selected in units of horizontal lines.

In this case, the scan signal may have a voltage level that enables a transistor supplied with the scan signal can be turned on.

The emission driver 130 may supply emission control signals to the emission control lines E1 to En in response to an emission driver control signal ECS supplied from the timing controller 160.

For example, the emission driver 130 may sequentially supply the emission control signals to the emission control lines E1 to En.

In this case, the emission control signal may have a voltage level that enables a transistor supplied with the emission control signal to be turned off.

The initialization driver 140 may supply initialization signals to the initialization lines C1 to Cn in response to an initialization driver control signal CCS supplied from the timing controller 160.

For example, the initialization driver 140 may sequentially supply the initialization signals to the initialization lines C1 to Cn.

In this case, the initialization signal may have a voltage level that enables a transistor supplied with the initialization signal to be turned on.

The data driver 120 may supply data signals to the data lines D1 to Dm in response to a data driver control signal DCS.

The data signals supplied to the data lines D1 to Dm may be supplied to pixels PXL' selected by each scan signal.

To this end, the data driver 120 may supply the data signals to the data lines D1 to Dm in synchronization with the scan signals.

The timing controller 160 may generate the data driver control signal DCS, the scan driver control signal SCS, the emission driver control signal ECS, and the initialization drive control signal CCS in response to control signals supplied from the outside.

In this case, the scan driver control signal SCS may be supplied to the scan driver 110, the data driver control signal DCS may be supplied to the data driver 120, the emission driver control signal ECS may be supplied to the emission driver 130, and the initialization driver control signal CCS may be supplied to the initialization driver 140.

In addition, the timing controller 160 may convert image data input from the outside into image data Data suitable for specifications of the data driver 120, and supply the converted image data Data to the data driver 120.

The scan driver control signal SCS may include a scan start signal and clock signals. The scan start signal may control supply timings of the scan signals, and the clock signals may be used to shift the scan start signal.

The emission driver control signal ECS may include an emission start signal and clock signals. The emission start signal may control supply timings of the emission control signals, and the clock signals may be used to shift the emission start signal.

The initialization driver control signal CCS may include an initialization start signal and clock signals. The initialization start signal may control supply timings of the initialization signals, and the clock signals may be used to shift the initialization start signal.

The data driver control signal DCS may include a source start signal, a source output enable signal, a source sampling clock, and the like. The source start signal may control a data sampling start time of the data driver 120. The source sampling clock may control a sampling operation of the data driver 120, based on a rising or falling edge. The source output enable signal may control an output timing of the data driver 120.

The (n+1) scan lines S0 to Sn, n emission control lines E1 to En, and n initialization lines C1 to Cn are illustrated in FIG. 9; however, the present disclosure is not limited thereto. For example, dummy scan lines, dummy emission control lines, and dummy initialization lines may be additionally formed so as to achieve the stability of driving.

In FIG. 9, it is illustrated that the scan driver 110, the data driver 120, the emission driver 130, the initialization driver 140, and the timing controller 160 are individually provided as separate blocks; however, at least some of the components may be integrated, if desired.

In addition, the scan driver 110, the data driver 120, the emission driver 130, the initialization driver 140, and the timing controller 160 may be installed in various suitable ways including chip on glass, chip on plastic, tape carrier package, chip on film, and the like.

Figure 10:
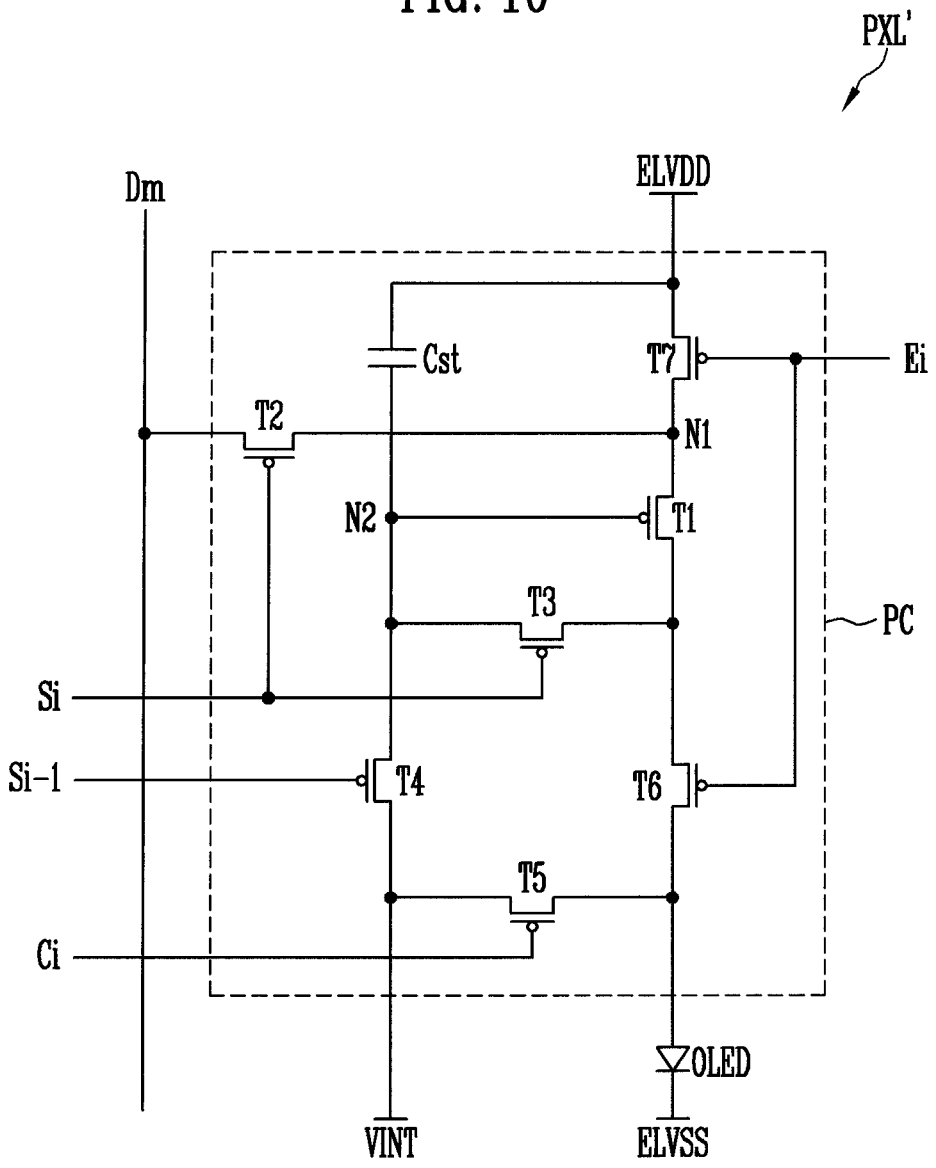
FIG. 10 is a circuit diagram illustrating a pixel according to the other embodiment of the present disclosure.

FIG. 10 is a circuit diagram illustrating a pixel according to the other embodiment of the present disclosure. For convenience of description, a pixel PXL' coupled to an ith (i is a natural number) initialization line C1 and an mth (m is a natural number) data line Dm is illustrated in FIG. 10.

Referring to FIG. 10, the pixel PXL' according to an embodiment of the present disclosure may include a pixel circuit PC and an organic light emitting diode OLED.

An anode electrode of the organic light emitting diode OLED may be coupled to the pixel circuit PC, and a cathode electrode of the organic light emitting diode OLED may be coupled to the second pixel power source ELVSS.

The organic light emitting diode OLED may generate light with a set or predetermined luminance corresponding to a driving current supplied from the pixel circuit PC.

The first pixel power source ELVDD may be set to a voltage higher than that of the second pixel power source ELVSS such that a current can flow through the organic light emitting diode OLED.

The pixel circuit PC may control the amount of driving current flowing from the first pixel power source ELVDD to the second pixel power source ELVSS via the organic light emitting diode OLED, corresponding to a data signal. To this end, the pixel circuit PC may include a first transistor T1, a second transistor T2, a third transistor T3, a fourth transistor T4, a fifth transistor (i.e., an initialization transistor) T5, at least one emission control transistor, and a storage capacitor Cst.

A first electrode of the first transistor (i.e., a driving transistor) T1 may be coupled to the first node N1, and a second electrode of the first transistor T1 may be coupled to a first electrode of a sixth transistor T6. In addition, a gate electrode of the first transistor T1 may be coupled to the second node N2. The first transistor T1 may control the amount of driving current flowing from the first pixel power source ELVDD to the second pixel power source ELVDD via the organic light emitting diode OLED, corresponding to a data signal supplied to the mth data line Dm.

The second transistor T2 may be coupled between the mth data line Dm and the first node N1. In other words, the second transistor T2 may be coupled to the first electrode of the first transistor T1 and the mth data line Dm.

In addition, a gate electrode of the second transistor T2 may be coupled to an ith scan line Si. The second transistor T2 may be turned on when a scan signal is supplied to the ith scan line Si, to allow the mth data line Dm and the first node N1 to be electrically coupled to each other.

The third transistor T3 may be coupled between the second electrode of the first transistor T1 and the second node N2. In other words, the third transistor T3 may be coupled between the gate electrode of the first transistor T1 and the second electrode of the first transistor T1.

In addition, a gate electrode of the third transistor T3 may be coupled to the ith scan line Si. The third transistor T3 may be turned on when the scan signal is supplied to the ith scan line Si, to allow the first transistor T1 to be diode-coupled.

The fourth transistor T4 may be coupled between the second node N2 and the third pixel power source VINT. In other words, the fourth transistor T4 may be coupled between the gate electrode of the first transistor T1 and the third pixel power source VINT.

In addition, a gate electrode of the fourth transistor T4 may be coupled to an (i−1)th scan line Si−1. The fourth transistor T4 may be turned on when a scan signal is supplied to the (i−1)th scan line Si−1, to supply the voltage of the third pixel power source VINT to the second node N2.

The fifth transistor T5 is an initialization transistor, and may be coupled between the anode electrode of the organic light emitting diode OLED and the third pixel power source VINT.

In addition, a gate electrode of the fifth transistor T5 may be coupled to the ith initialization line Ci.

The fifth transistor T5 may supply an initialization voltage to the anode electrode of the organic light emitting diode OLED, corresponding to an initialization signal supplied to the ith initialization line Ci.

In other words, the fifth transistor T5 may be turned on when the initialization signal is supplied to the ith initialization line Ci, to supply the voltage of the third pixel power source VINT (i.e., the initialization voltage) to the anode electrode of the organic light emitting diode OLED.

The voltage of the third pixel power source VINT may be set as a voltage lower than that of the data signal.

The emission control transistor may be located on a path of a driving current, and block the driving current, corresponding to an emission control signal supplied to the ith emission control line Ei.

For example, the emission control transistor may include the sixth transistor (i.e., a first emission control transistor) T6 and a seventh transistor (i.e., a second emission control transistor) T7.

The sixth transistor T6 may be coupled between the second electrode of the first transistor T1 and the anode electrode of the organic light emitting diode OLED. In addition, a gate electrode of the sixth transistor T6 may be coupled to the ith emission control line Ei. The sixth transistor T6 may be turned off when the emission control signal is supplied to the ith emission control line Ei, and be turned on when the emission control signal is not supplied.

The seventh transistor T7 may be coupled between the first pixel power source ELVDD and the first node N1. In other words, the seventh transistor T7 may be coupled between the first pixel power source ELVDD and the first electrode of the first transistor T1.

In addition, a gate electrode of the seventh transistor T7 may be coupled to the ith emission control line Ei. The seventh transistor T7 may be turned off when the emission control signal is supplied to the ith emission control line Ei, and be turned on when the emission control signal is not supplied.

The storage capacitor Cst may be coupled between the first pixel power source ELVDD and the second node N2. In other words, the storage capacitor Cst may be coupled between the first pixel power source ELVDD and the gate electrode of the first transistor T1.

The storage capacitor Cst may store a voltage corresponding to the data signal and the threshold voltage of the first transistor T1.

In the present disclosure, the organic light emitting diode OLED may generate various suitable light colors including red, green, and blue, corresponding to the amount of current supplied from the driving transistor; however, the present disclosure is not limited thereto. For example, the organic light emitting diode OLED may generate white light, corresponding to the amount of current supplied from the driving transistor. In this case, a color image can be implemented using a separate color filter, or the like.

Figure 11:
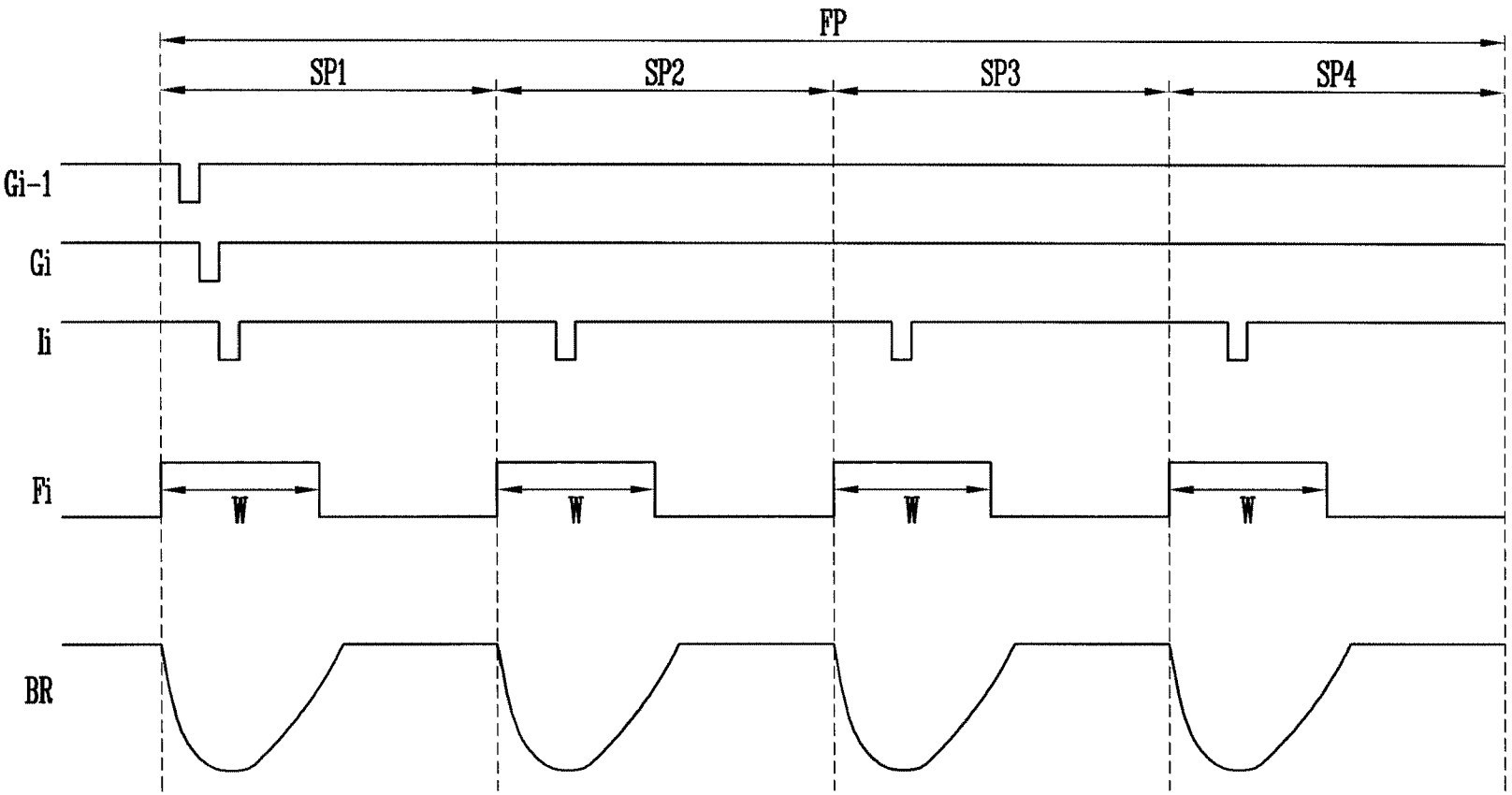
FIG. 11 is a waveform diagram illustrating an operation of the pixel according to an embodiment of the present disclosure.

FIG. 11 is a waveform diagram illustrating an operation of the pixel according to an embodiment of the present disclosure. In particular, during one frame period FP, a scan signal Gi−1 supplied to the (i−1)th scan line Si−1, a scan signal Gi supplied to the ith scan line Si, an initialization signal Ii supplied to the ith initialization line Ci, and an emission control signal Fi supplied to the ith emission control line Ei are illustrated in FIG. 11.

Referring to FIG. 11, the one frame period FP may include a plurality of sub-periods SP1, SP2, SP3, and SP4.

For example, the one frame period FP may include a first sub-period SP1, a second sub-period SP2, a third sub-period SP3, and a fourth sub-period SP4.

In the first sub-period SP1, the emission control signal Fi is first supplied to the ith emission control line Ei. When the emission control signal Fi is supplied to the ith emission control line Ei, the sixth transistor T6 and the seventh transistor T7, which are emission control transistors, may be turned off. In this case, the pixel PXL' may be set to the non-emission state.

Subsequently, the scan signal Gi−1 is supplied to the (i−1)th scan line Si−1 such that the fourth transistor T4 is turned on. When the fourth transistor T4 is turned on, the voltage of the third pixel power source VINT may be supplied to the second node N2. Then, the second node N2 may be initialized to the voltage of the third pixel power source VINT.

After the second node N2 is initialized to the voltage of the third pixel power source VINT, the scan signal Gi is supplied to the ith scan line Si. When the scan signal Gi is supplied to the ith scan line Si, the second transistor T2 and the third transistor T3 may be turned on.

When the third transistor T3 is turned on, the first transistor T1 may be diode-coupled.

When the second transistor T2 is turned on, a data signal from the mth data line Dm may be supplied to the first electrode of the first transistor T1 (e.g., the first node N1). At this time, because the second node N2 is initialized to the voltage of the third pixel power source VINT, which is lower than that of the data signal, the first transistor T1 may be turned on. When the first transistor T1 is turned on, a voltage obtained by subtracting the threshold voltage of the first transistor T1 from the data signal is applied to the second node N2. The storage capacitor Cst stores a voltage corresponding to the data signal applied to the second node N2 and the threshold voltage of the first transistor T1.

Subsequently, the initialization signal Ii is supplied to the ith initialization line Ci. When the initialization signal Ii is supplied to the ith initialization line Ci, the fifth transistor T5 may be turned on.

Subsequently, the scan signal Gi+1 is supplied to the (i+1)th scan line Si+1. When the scan signal Gi+1 is supplied to the (i+1)th scan line Si+1, the fifth transistor T5 may be turned on.

When the fifth transistor T5 is turned on, the voltage of the third pixel power source VINT is supplied to the anode electrode of the organic light emitting diode OLED. Then, a parasitic capacitor parasitically formed in the organic light emitting diode OLED is discharged, and accordingly, the black expression ability of the pixel PXL can be improved.

After that, the supply of the emission control signal Fi to the ith emission control line Ei is stopped. When the supply of the emission control signal Fi to the ith emission control line Ei is stopped, the sixth transistor T6 and the seventh transistor T7 may be turned on. Then, there is formed a current path extending from the first pixel power source ELVDD to the second pixel power source ELVSS via the seventh transistor T7, the first transistor T1, the sixth transistor T6, and the organic light emitting diode OLED.

At this time, the first transistor T1 controls the amount of driving current flowing the first pixel power source ELVDD to the second pixel power source ELVSS via the organic light emitting diode OLED, corresponding to the voltage of the second node N2. The organic light emitting diode OLED generates light with a set or predetermined luminance corresponding to the amount of current supplied from the first transistor T1.

During the second sub-period SP2, the emission control signal Fi may be again supplied to the ith emission control line Ei.

In this case, because the sixth transistor T6 and the seventh transistor T7 are turned off, the driving current is blocked, and accordingly, the pixel PXL' may be set to the non-emission state.

In addition, the initialization signal Ii may be supplied to the ith initialization line Ci during the second sub-period SP2.

In this case, because the fifth transistor T5 is turned on, the anode electrode of the organic light emitting diode OLED may be initialized.

When the supply of the emission control signal Fi is stopped, the sixth transistor T6 and the seventh transistor T7 are turned on, and therefore, the pixel PXL may be again set to an emission state.

Like the second sub-period SP2 described above, the supply of the emission control signal Fi and the initialization signal Ii may be performed in the third sub-period SP3 and the fourth sub-period SP4.

In each of the sub-periods SP1, SP2, SP3, and SP4, the initialization signal Ii may overlap with the emission control signal Fi supplied to the ith emission control line Ei.

Accordingly, in each of the sub-periods SP1, SP2, SP3, and SP4, the on period of the fifth transistor T5 may overlap with the off period of the sixth transistor T6 and the seventh transistor T7.

That is, as described above in relation to FIG. 3, the flick phenomenon occurs when the organic light emitting diode OLED is initialized in only the first sub-period SP1.

On the other hand, in the embodiment of the present disclosure, the operation of initializing the organic light emitting diode OLED is performed for each of the sub-periods SP1, SP2, SP3, and SP3 included in the one frame period FP, and thus the flicker phenomenon can be reduced.

Figure 12:
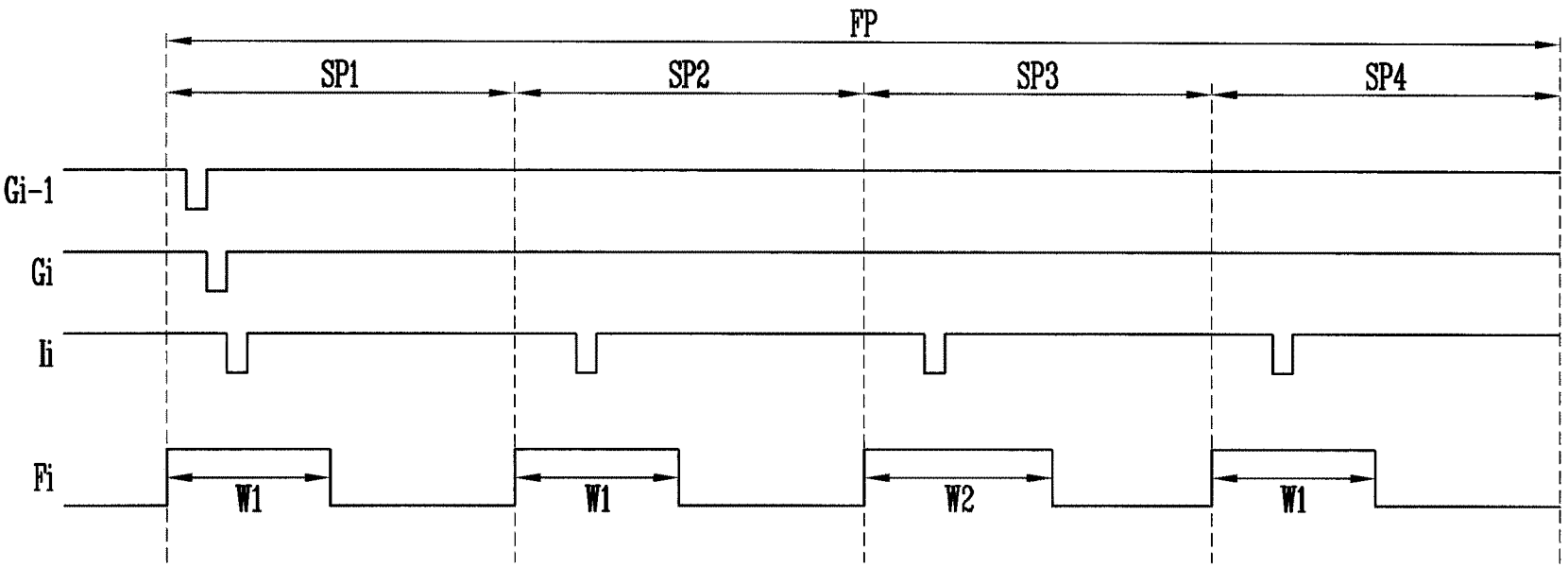
FIG. 12 is a waveform diagram illustrating an operation of a pixel according to still another embodiment of the present disclosure.

FIG. 12 is a waveform diagram illustrating an operation of a pixel according to still another embodiment of the present disclosure.

Referring to FIG. 12, the initialization signal Ii may be supplied for each of the sub-periods SP1, SP2, SP3, and SP4, and concurrently (e.g., simultaneously), a width of the emission control signal Fi supplied in any one sub-period among the sub-periods SP1, SP2, SP3, and SP4 may be set differently from that of the emission control signal Fi supplied in another sub-period (see FIG. 4).

That is, a width W2 of the emission control signal Fi supplied in the third sub-period SP3 may be set wider than the width W1 of the emission control single Fi supplied in the first sub-period SP1, the second sub-period SP2, and the fourth sub-period SP4.

Figure 13:
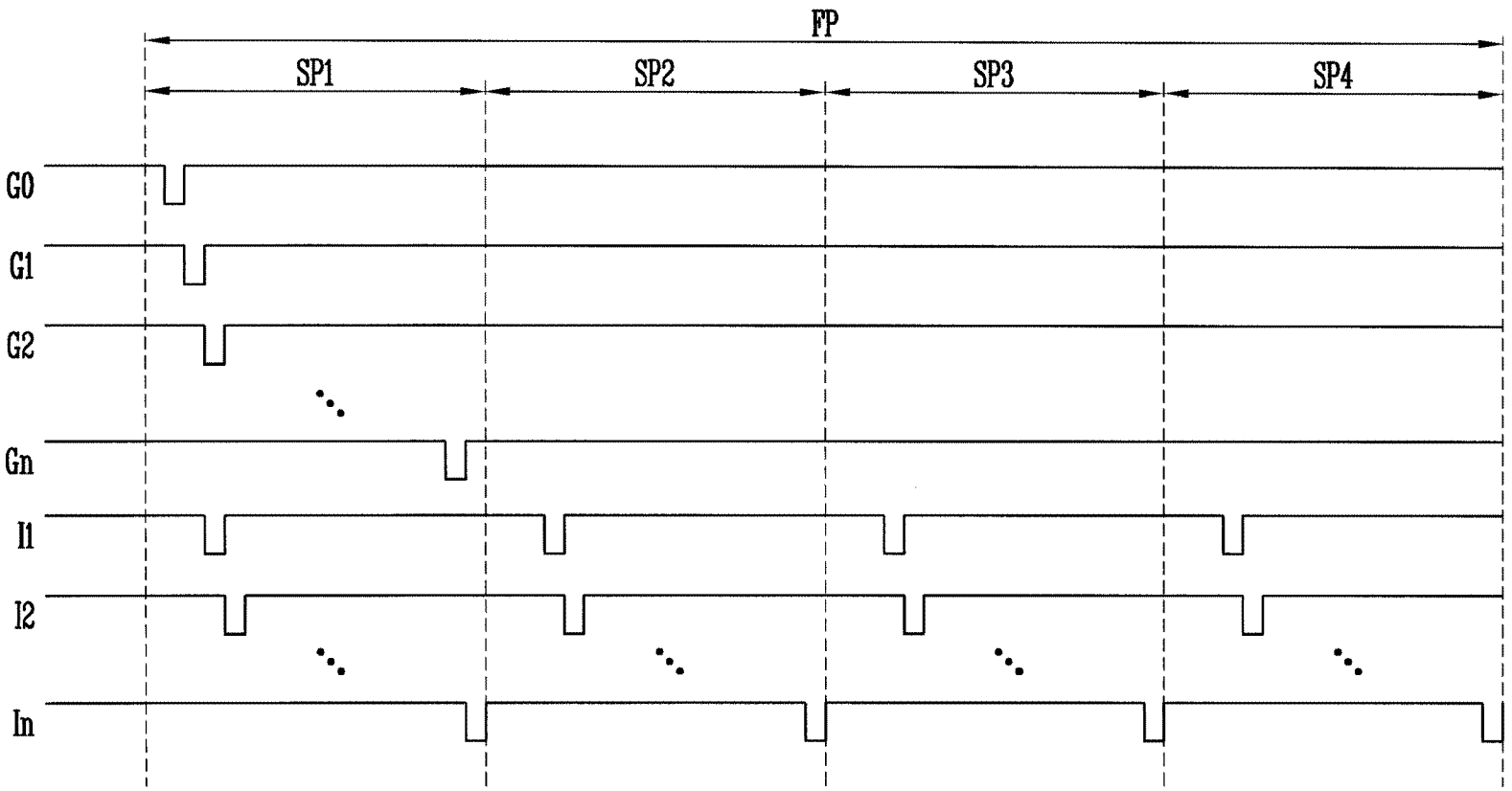
FIG. 13 is a waveform diagram illustrating operations of a scan driver and an initialization driver according to an embodiment of the present disclosure.

FIG. 13 is a waveform diagram illustrating operations of the scan driver and the initialization driver according to an embodiment of the present disclosure. In particular, operations of the scan driver 100 and the initialization driver 140 during one frame period FP are illustrated in FIG. 13.

Referring to FIG. 13, the one frame period FP may include a plurality of sub-periods SP1, SP2, SP3, and SP4.

For example, the one frame period FP may include a first sub-period SP1, a second sub-period SP2, a third sub-period SP3, and a fourth sub-period SP4.

The scan driver 110 may supply scan signals G0 to Gn during the first sub-period SP1.

In addition, the initialization driver 140 may supply initialization signals I1 to In during each of the sub-periods SP1, SP2, SP3, and SP4.

As described above, the initialization signals I1 to In are supplied for each of the sub-periods SP1, SP2, SP3, and SP4, so that the flicker phenomenon can be reduced.

According to the present disclosure, it is possible to provide a pixel and a display device including the same, which can provide improved image quality by reducing a flicker phenomenon.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two elements, it can be the only element between the two elements, or one or more intervening elements may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein, such as the scan driver, data driver, an emission driver, and the timing controller, may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense, and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various suitable changes in form and details may be made without departing from the spirit and scope of the present disclosure as defined by the following claims and equivalents thereof.

What is claimed is:

1. A display device comprising:

pixels coupled to scan lines, emission control lines, and data lines;

a scan driver configured to supply scan signals to the pixels through the scan lines;

an emission driver configured to supply emission control signals to the pixels through the emission control lines; and a data driver configured to supply data signals to the pixels through the data lines, wherein the emission driver is configured to supply the emission control signals for each one of sub-periods in one frame period, wherein the one frame period comprises a first sub-period, a second sub-period, a third sub-period, and a fourth sub-period, which are sequentially ordered, wherein the scan driver is configured to supply the scan signals during the first sub-period and not during the second, third, and fourth sub-periods, and wherein the emission control signals in the third sub-period have a first width, and the emission control signals in the first, second, and fourth sub-periods have a second width that is less than the first width.

2. The display device of claim 1, wherein the emission driver is further configured to control a non-emission period of the pixels via the emission control signals.

3. The display device of claim 1, wherein a pixel coupled to an ith (i being a natural number) emission control line and an mth (m being a natural number) data line from among the pixels comprises:

an organic light emitting diode;

a first transistor configured to control an amount of driving current flowing from a first pixel power source to a second pixel power source via the organic light emitting diode, corresponding to a data signal of the data signals supplied to the mth data line; and an emission control transistor on a path of the driving current, the emission control transistor being configured to block the driving current, corresponding to an emission control signal of the emission control signals supplied from the ith emission control line.

4. The display device of claim 3, wherein the pixel coupled to the ith emission control line and the mth data line further comprises:

a second transistor coupled between a first electrode of the first transistor and the mth data line;

a third transistor coupled between a gate electrode of the first transistor and a second electrode of the first transistor;

a fourth transistor coupled between the gate electrode of the first transistor and a third pixel power source;

a fifth transistor coupled between the third pixel power source and an anode electrode of the organic light emitting diode; and a storage capacitor coupled between the first pixel power source and the gate electrode of the first transistor.

5. The display device of claim 4, wherein the emission control transistor comprises:

a first emission control transistor coupled between the second electrode of the first transistor and the anode electrode of the organic light emitting diode, the first emission control transistor comprising a gate electrode coupled to the ith emission control line; and a second emission control transistor coupled between the first pixel power source and the first electrode of the first transistor, the second emission control transistor comprising a gate electrode coupled to the ith emission control line.

6. A pixel comprising:

an organic light emitting diode;

a first transistor configured to control an amount of driving current flowing from a first pixel power source to a second pixel power source via the organic light emitting diode, corresponding to a data signal supplied to a data line;

a second transistor coupled between a first electrode of the first transistor and the data line; and an emission control transistor on a path of the driving current, the emission control transistor being configured to block the driving current, corresponding to an emission control signal supplied to an emission control line, wherein the emission control transistor is turned off for each one of sub-periods in one frame period, wherein the one frame period comprises a first sub-period, a second sub-period, a third sub-period, and a fourth sub-period, which are sequentially ordered, wherein the second transistor is turned on in the first sub-period, and is not turned on in the second, third, and fourth sub-periods, and wherein an off period of the emission control transistor in the third sub-period is a first length of time, and the off period of the emission control transistor in the first, second, and fourth sub-periods is a second length of time that is less than the first length of time.

7. The pixel of claim 6, further comprising:

a third transistor coupled between a gate electrode of the first transistor and a second electrode of the first transistor;

a fourth transistor coupled between the gate electrode of the first transistor and a third pixel power source;

a fifth transistor coupled between the third pixel power source and an anode electrode of the organic light emitting diode; and a storage capacitor coupled between the first pixel power source and the gate electrode of the first transistor.

8. The pixel of claim 7, wherein the emission control transistor comprises:

a first emission control transistor coupled between the second electrode of the first transistor and the anode electrode of the organic light emitting diode, the first emission control transistor comprising a gate electrode coupled to the emission control line; and a second emission control transistor coupled between the first pixel power source and the first electrode of the first transistor, the second emission control transistor comprising a gate electrode coupled to the emission control line.

9. A display device comprising:

pixels coupled to scan lines, emission control lines, initialization lines, and data lines, each one of the pixels comprising an organic light emitting diode;

a scan driver configured to supply scan signals to the pixels through the scan lines;

an emission driver configured to supply emission control signals, for each one of sub-periods in one frame period, to the pixels through the emission control lines;

an initialization driver configured to supply initialization signals to the pixels through the initialization lines; and a data driver configured to supply data signals to the pixels through the data lines, wherein the organic light emitting diode of each one of the pixels is initialized in each one of sub-periods in one frame period, wherein the one frame period comprises a first sub-period, a second sub-period, a third sub-period, and a fourth sub-period, which are sequentially ordered, wherein the scan driver is configured to supply the scan signals during the first sub-period and not during the second, third, and fourth sub-periods, and wherein the emission control signals in the third sub-period have a first width, and the emission control signals in the first, second, and fourth sub-periods have a second width that is less than the first width.

10. The display device of claim 9, wherein the initialization driver is configured to output the initialization signals during each one of the sub-periods, and wherein the emission driver is configured to output the emission control signals during each one of the sub-periods.

11. The display device of claim 10, wherein the initialization driver is configured to control initialization of the organic light emitting diodes via the initialization signals, and wherein the emission driver is configured to control a non-emission period of the pixels via the emission control signals.

12. The display device of claim 9, wherein a pixel coupled to an ith (i being a natural number) initialization line, an ith emission control line, and an mth (m being a natural number) data line from among the pixels comprises:

a first transistor configured to control an amount of driving current flowing from a first pixel power source to a second pixel power source via the organic light emitting diode, corresponding to a data signal of the data signals supplied to the mth data line;

an initialization transistor configured to supply an initialization voltage to an anode electrode of the organic light emitting diode, corresponding to an initialization signal supplied to the ith initialization line; and an emission control transistor on a path of the driving current, the emission control transistor being configured to block the driving current, corresponding to an emission control signal of the emission control signals supplied to the ith emission control line.

13. The display device of claim 12, wherein the pixel coupled to the ith initialization line, the ith emission control line, and the mth data line further comprises:

a second transistor coupled between a first electrode of the first transistor and the mth data line;

a third transistor coupled between a gate electrode of the first transistor and a second electrode of the first transistor;

a fourth transistor coupled between the gate electrode of the first transistor and a third pixel power source; and a storage capacitor coupled between the first pixel power source and the gate electrode of the first transistor.

14. The display device of claim 13, wherein the emission control transistor comprises:

a first emission control transistor coupled between the second electrode of the first transistor and the anode electrode of the organic light emitting diode, the first emission control transistor comprising a gate electrode coupled to the ith emission control line; and a second emission control transistor coupled between the first pixel power source and the first electrode of the first transistor, the second emission control transistor comprising a gate electrode coupled to the ith emission control line.

15. A pixel comprising:

an organic light emitting diode;

a first transistor configured to control an amount of driving current flowing from a first pixel power source to a second pixel power source via the organic light emitting diode, corresponding to a data signal supplied to a data line;

a second transistor coupled between a first electrode of the first transistor and the data line;

an initialization transistor configured to supply an initialization voltage to an anode electrode of the organic light emitting diode, corresponding to an initialization signal supplied to an initialization line; and an emission control transistor located on a path of the driving current, the emission control transistor being configured to block the driving current, corresponding to an emission control signal supplied to an emission control line, wherein the initialization transistor supplies the initialization voltage to the anode electrode of the organic light emitting diode for each one of sub-periods in one frame period, wherein the one frame period comprises a first sub-period, a second sub-period, a third sub-period, and a fourth sub-period, which are sequentially ordered, wherein the second transistor is turned on in the first sub-period, and is not turned on in the second, third, and fourth sub-periods, and wherein an off period of the emission control transistor in the third sub-period is a first length of time, and the off period of the emission control transistor in the first, second, and fourth sub-periods is a second length of time less that is less than the first length of time.

16. The pixel of claim 15, wherein an on period of the initialization transistor overlaps with an off period of the emission control transistor during each one of the sub-periods.

17. The pixel of claim 15, further comprising:

a third transistor coupled between a gate electrode of the first transistor and a second electrode of the first transistor;

a fourth transistor coupled between the gate electrode of the first transistor and a third pixel power source; and a storage capacitor coupled between the first pixel power source and the gate electrode of the first transistor.

18. The pixel of claim 15, wherein the emission control transistor comprises:

a first emission control transistor coupled between a second electrode of the first transistor and the anode electrode of the organic light emitting diode, the first emission control transistor comprising a gate electrode coupled to the emission control line; and a second emission control transistor coupled between the first pixel power source and the first electrode of the first transistor, the second emission control transistor comprising a gate electrode coupled to the emission control line.

* * * * *